US006481388B1

(12) United States Patent
Yamamoto

(10) Patent No.: US 6,481,388 B1
(45) Date of Patent: Nov. 19, 2002

(54) COOLING FAN DRIVE CONTROL DEVICE

(75) Inventor: Yuuichi Yamamoto, Oyama (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/553,548

(22) Filed: Apr. 20, 2000

(51) Int. Cl.[7] ..... F01P 9/00
(52) U.S. Cl. ..... 123/41.12; 123/41.1
(58) Field of Search ..... 123/41.12, 41.49, 123/41.1

(56) References Cited

U.S. PATENT DOCUMENTS 4,539,943 A * 9/1985 Tsuchikawa et al. ..... 123/41.12
4,913,102 A * 4/1990 Ohmura et al. ..... 123/41.12
4,971,525 A * 11/1990 Nakayoshi et al. ..... 123/41.12
5,224,446 A * 7/1993 Okita et al. ..... 123/41.12
5,531,190 A * 7/1996 Mork ..... 123/41.12
5,839,279 A * 11/1998 Moriya et al. ..... 60/445
5,851,441 A * 12/1998 Kato et al. ..... 261/26
5,960,748 A * 10/1999 Lewis ..... 123/41.12
5,971,068 A * 10/1999 Ochiai et al. ..... 165/290
6,010,309 A * 1/2000 Takamura et al. ..... 60/449
6,016,774 A * 1/2000 Bokkers et al. ..... 123/41.12
6,044,809 A * 4/2000 Till et al. ..... 123/41.12
6,076,488 A * 6/2000 Yamagishi ..... 123/41.12
6,142,110 A * 11/2000 Bartley et al. ..... 123/41.12
6,161,522 A * 12/2000 Fuchita et al. ..... 123/385
6,170,262 B1 * 1/2001 Yoshimura et al. ..... 60/452
6,178,928 B1 * 1/2001 Corriveau ..... 123/41.12
6,179,043 B1 * 1/2001 Betz ..... 123/41.49

* cited by examiner

*Primary Examiner*—Noah P. Kamen
*Assistant Examiner*—Jason Benton
(74) *Attorney, Agent, or Firm*—Varndell & Varndell, PLLC

(57) ABSTRACT

A target fan rotation speed $FAN_{RPM}$ is set corresponding to the temperature $T_c$ sensed by a cooling water temperature sensing unit. A capacity control unit (controller, EPC valve )is then used to control the capacity of a hydraulic pump (or a hydraulic motor) so that the fan rotation speed N of the cooling fan becomes the target fan rotation speed $FAN_{RPM}$. In this way, when the cooling fan is driven by a hydraulic source, it can be driven with optimal energy efficiency and noise can be controlled to a minimum.

32 Claims, 14 Drawing Sheets

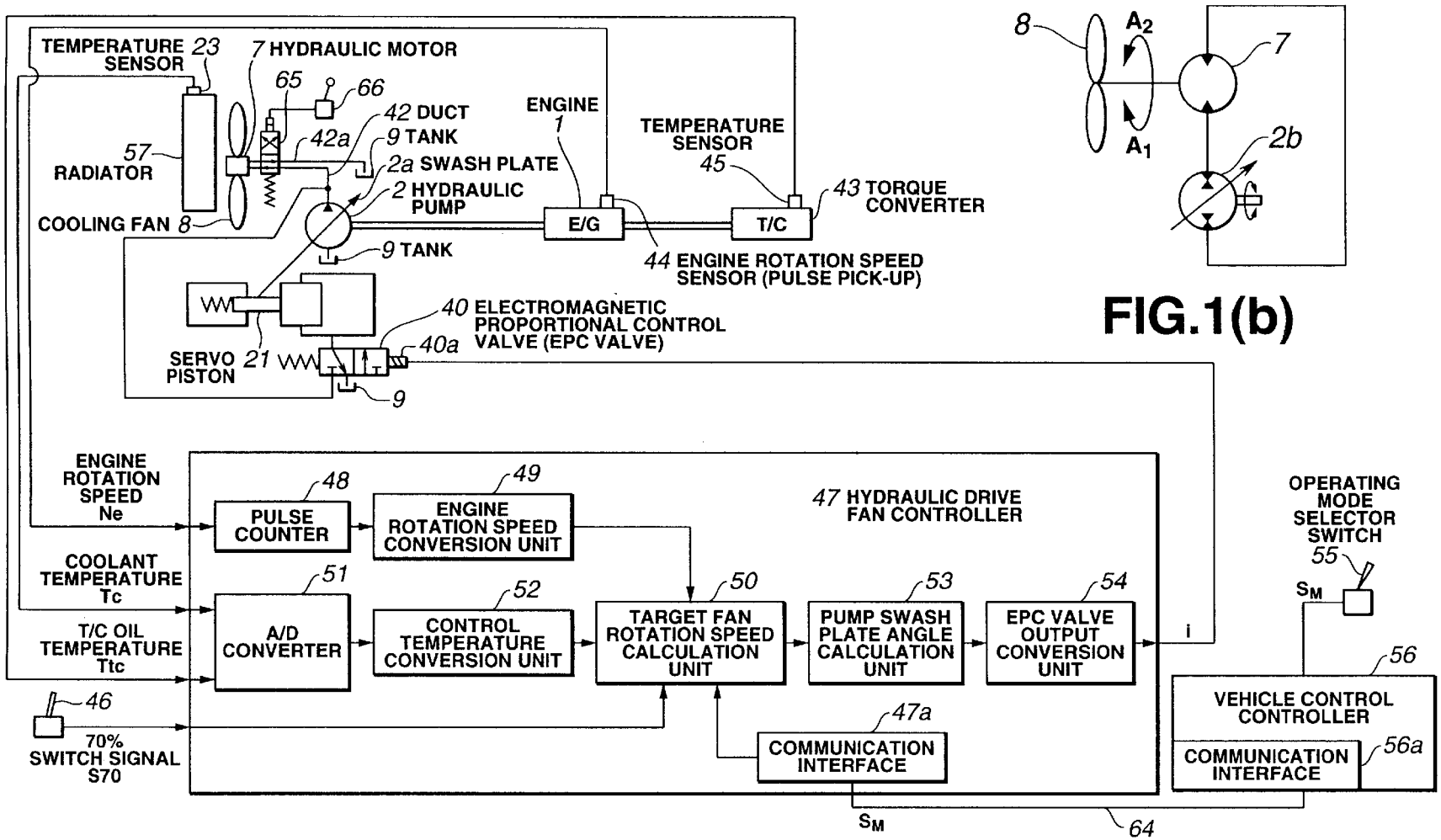
7
2b
A2
A1
8
FIG.1(b)
OPERATING MODE SELECTOR SWITCH
55
SM
56
VEHICLE CONTROL CONTROLLER
56a
COMMUNICATION INTERFACE
64
i
47 HYDRAULIC DRIVE FAN CONTROLLER
54
EPC VALVE OUTPUT CONVERSION UNIT
53
PUMP SWASH PLATE ANGLE CALCULATION UNIT
47a
COMMUNICATION INTERFACE
SM
50
TARGET FAN ROTATION SPEED CALCULATION UNIT
49
ENGINE ROTATION SPEED CONVERSION UNIT
52
CONTROL TEMPERATURE CONVERSION UNIT
48
PULSE COUNTER
51
A/D CONVERTER
ENGINE ROTATION SPEED Ne
COOLANT TEMPERATURE Tc
T/C OIL TEMPERATURE Ttc
46
70% SWITCH SIGNAL S70
43 TORQUE CONVERTER
T/C
TEMPERATURE SENSOR
45
44 ENGINE ROTATION SPEED SENSOR (PULSE PICK-UP)
E/G
ENGINE
1
40 ELECTROMAGNETIC PROPORTIONAL CONTROL VALVE (EPC VALVE)
40a
9
9 TANK
2 HYDRAULIC PUMP
2a SWASH PLATE
42 DUCT
9 TANK
42a
66
65
7 HYDRAULIC MOTOR
21
SERVO PISTON
23
TEMPERATURE SENSOR
57
RADIATOR
COOLING FAN 8
FIG.1(a)

COOLING FAN DRIVE CONTROL DEVICE

BACKGROUND OF THE INVENTION

1. Field of the Invention

The present invention relates to a device that drives a cooling fan.

2. Description of the Related Art

In hydraulically driven machinery such as construction machinery, an engine drives a hydraulic pump, and pressure oil discharged from the hydraulic pump is supplied to hydraulic actuators such as hydraulic cylinders via control valves. In this way, the machinery is able to operate.

The engine and the pressure oil have to be cooled.

Cooling devices that use water-cooling techniques are principally used for the cooling of engines. Specifically, cooling is performed by circulating a coolant cooling water through a water jacket provided in the engine main body. Coolant that has been heated up inside the water jacket is guided to a radiator where it is cooled down, and the cooled coolant is then returned to the water jacket.

The pressure oil is cooled by guiding the oil through an oil cooler. Energy losses inside the hydraulic circuit are conducted to the pressure oil in the form of heat. Like the coolant, the pressure oil is guided to an oil cooler where it is cooled down, and the cooled pressure oil is then returned to the hydraulic circuit.

The radiator and oil cooler are both cooled by a flow of air generated by a cooling fan. In most cases the oil cooler and radiator are installed sequentially along the passage of the airflow generated by the cooling fan. This specific arrangement is normally considered to be efficient for cooling purposes.

This cooling fan is attached to the drive shaft of the engine. The rotation speed of the cooling fan thus depends on the rotation speed of the engine.

There is a demand for freedom of layout of the engine and cooling fan as a means of addressing problems associated with the space available for their installation. Consequently, a measure has been adopted whereby the cooling fan is made independent of the engine. This approach is disclosed in Japanese Patent Application Laid-open No. 6-58145.

This publication describes an invention wherein a variable capacity hydraulic pump for driving the fan and a fixed capacity hydraulic motor for driving the fan are installed separately from the engine, and the cooling fan is driven by supplying the pressure oil discharged from the variable capacity hydraulic pump for driving the fan to the fixed capacity hydraulic motor for driving the fan.

In this case, a solenoid control valve for exclusive fan drive use is provided which controls the swash plate of the variable capacity hydraulic pump. Then, according to which temperature range the coolant temperature falls into from among three stages of temperatures, a control signal is applied to the solenoid of the abovementioned solenoid control valve, and the rotation speed of the cooling fan is thereby switched between three stages.

A technique disclosed in Japanese Unexamined Patent Application JP-A No. S63-124820 has also been employed.

This publication describes an invention wherein a fixed capacity hydraulic pump for driving the fan and a fixed capacity hydraulic motor for driving the fan are provided separately from the engine, and the cooling fan is driven by supplying the pressure oil discharged from the fixed capacity hydraulic pump for driving the fan to the fixed capacity hydraulic motor for driving the fan via a flow rate control valve.

In this case, the fixed capacity hydraulic pump discharges pressure oil at a flow rate corresponding to the magnitude of the engine rotation speed. Then, by controlling the aperture of the flow rate control valve, the flow rate of the pressure oil supplied from the fixed capacity hydraulic pump to the fixed capacity hydraulic motor is controlled, and the rotation speed of the cooling fan is controlled.

To reduce the noise produced by construction machinery, there has also been a demand in recent years for reducing the fan rotation speed and reducing energy losses.

In all the inventions described in the abovementioned publications, the cooling fan is driven with a hydraulic pump as a drive source that is separate from the engine. This has the effect of increasing the freedom in the arrangement of the cooling fan radiator, oil cooler and other equipment, and makes it possible to shield the engine while cooling it with the cooling fan at the same time. However, these inventions have suffered from the following problems.

Specifically, the invention of the abovementioned Japanese Patent Application Laid-open No. 6-58145 only controls the rotation speed of the cooling fan in three stages according to which of the three stages of temperature regions the coolant temperature belongs to. As a result, the coolant is not necessarily cooled with optimal energy efficiency. The noise generated by the cooling fan itself may also become greater then necessary. Specifically, since the rotation speed of the cooling fan is varied in three stages, there will be cases when the cooling fan is rotated at a greater speed than is necessary and sufficient for cooling. The noise produced by the cooling fan also increases by an amount corresponding to this increase in rotation speed.

Also, the invention of the abovementioned Japanese Patent Application Laid-open No. 63-124820 only controls the pressure oil supplied to the fixed capacity hydraulic motor from the fixed capacity hydraulic pump by controlling the aperture of the flow rate control valve. Consequently, energy losses occur due to the recirculation of pressure oil from the flow rate control valve to the tank.

Specifically, since the flow rate of pressure oil discharged from the fixed capacity hydraulic pump increases correspondingly with increases in the engine rotation speed, a large amount of pressure oil is restricted by the flow control valve and recirculated to the tank when the engine rotation speed is large. Thus, when the engine rotation speed is large, the amount recirculated to the tank increases and energy losses occur.

Therefore, the present invention is directed at solving the problem of making it possible to drive a cooling fan with a hydraulic source in the most energy efficient way, and at enabling the noise to be controlled to a minimum.

SUMMARY OF THE INVENTION

Therefore, the first invention of the present invention is a cooling fan drive control device equipped with a hydraulic pump 2 driven by a drive source 1, a cooling fan 8 which cools cooling water of the drive source 1, and a hydraulic motor 7 which is operated by pressure oil discharged from the hydraulic pump 2 and causes the cooling fan 8 to rotate, wherein it also comprises:

a cooling water temperature sensing means 23 which senses a temperature of the cooling water, a target fan rotation speed setting means 50 which sets a target fan rotation speed corresponding to the temperature sensed by the cooling water temperature sensing means 23, and a capacity control means 47, 40 which controls a capacity 2*a* of the hydraulic pump 2 or the hydraulic motor 7 according to a difference between a fan rotation speed of the cooling fan 8 and the target fan rotation speed set by the target fan rotation speed setting means 50.

The first invention is described with reference to FIGS. 1(*a*) and 1(*b*) and FIG. 2.

With the first invention, a target fan rotation speed $FAN_{RPM}$ is set according to the temperature $T_c$ sensed by the cooling water temperature sensing means 23. The capacity 2*a* of the hydraulic pump 2 or hydraulic motor 7 is then controlled by the capacity control means controller 47, EPC valve 40 so that the fan rotation speed N of the cooling fan 8 becomes the abovementioned target fan rotation speed $FAN_{RPM}$.

With the first invention, a target fan rotation speed $FAN_{RPM}$ that is necessary and sufficient for cooling is determined from the current temperature $T_c$ of the cooling water, and the cooling fan 8 is rotated at this target fan rotation speed $FAN_{RPM}$.

Consequently, the cooling water is cooled with optimal energy efficiency. Also, the noise generated by the cooling fan itself does not become greater than is necessary. That is, since the rotation speed of the cooling fan is varied without stages to the rotation speed that is necessary and sufficient for cooling, the cooling fan does not rotate at a rotation speed greater than is necessary and sufficient for cooling. Consequently the rotation speed does not increase above the rotation speed that is necessary and sufficient for cooling, and energy losses do not occur. Also, no noise is generated by the cooling fan. And since there is no recirculation to the tank due to limiting the flow rate with a flow rate control valve, there are also no energy losses due to excessive flow rates.

Thus with the first invention, when driving a cooling fan with a hydraulic source, it is possible to drive it with optimal energy efficiency and to control noise to a minimum.

The second invention is a cooling fan drive control device which comprises a hydraulic pump 2 driven by a drive source 1, a cooling fan 8 which cools pressure oil of equipment 43 operated by the drive source 1, and a hydraulic motor 7 which is operated by pressure oil discharged from the hydraulic pump 2 and causes the cooling fan 8 to rotate, wherein it also comprises:

a pressure oil temperature sensing means 45 which senses a temperature of the pressure oil, a target fan rotation speed setting means 50 which sets a target fan rotation speed corresponding to the temperature sensed by the pressure oil temperature sensing means 45, and a capacity control means 47, 40 which controls a capacity of the hydraulic pump 2 or the hydraulic motor 7 according to a difference between a fan rotation speed of the cooling fan 8 and the target fan rotation speed set by the target fan rotation speed setting means 50.

The second invention is arrived at by substituting the cooling fan 8 which cools the cooling water in the first invention with a cooling fan 8 which cools the pressure oil.

With the second invention, similar advantages are obtained as with the first invention.

The third invention is a cooling fan drive control device which comprises a hydraulic pump 2 driven by a drive source 1, a cooling fan 8 which cools cooling water of the drive source 1 and also cools pressure oil of equipment 43 operated by the drive source 1, and a hydraulic motor 7 which is operated by pressure oil discharged from the hydraulic pump 2 and causes the cooling fan 8 to rotate, wherein it also comprises:

a cooling water temperature sensing means 23 which senses a temperature of the cooling water, a pressure oil temperature sensing means 45 which senses a temperature of the pressure oil, a target fan rotation speed setting means 50 which sets a target fan rotation speed to a first target fan rotation speed corresponding to the cooling water temperature sensed by the cooling water temperature sensing means 23 or to a second target fan rotation speed corresponding to the pressure oil temperature sensed by the pressure oil temperature sensing means 45, whichever is the larger, and a capacity control means 47, 40 which controls a capacity 2*a* of the hydraulic pump 2 or the hydraulic motor 7 according to a difference between a fan rotation speed of the cooling fan 8 and the target fan rotation speed set by the target fan rotation speed setting means 50.

The third invention is described with reference to FIGS. 1(*a*) and 1(*b*) and FIG. 2.

With the third invention, the target fan rotation speed $FAN_{RPM}$ is set to a first target fan rotation speed corresponding to the cooling water temperature $T_c$ sensed by the cooling water temperature sensing means 23 or to a second target fan rotation speed corresponding to the pressure oil temperature $T_{tc}$ sensed by the pressure oil temperature sensing means 45, whichever is the larger. The capacity control means (controller 47, EPC valve 40) then controls the capacity 2*a* of the hydraulic pump 2 (or hydraulic motor 7) so that the fan rotation speed N of the cooling fan 8 becomes the abovementioned target fan rotation speed $FAN_{RPM}$. Note that the pressure oil of equipment 43 driven by drive source 1 is taken to include, inter alia, the pressure oil of a torque converter 43 and the hydraulic cylinders that drive the operating machinery.

With the third invention, a target fan rotation speed $FAN_{RPM}$ that is necessary and sufficient for cooling is determined from the current temperature $T_c$ of the cooling water and the temperature $T_{tc}$ of the pressure oil, and the cooling fan 8 is rotated at this target fan rotation speed $FAN_{RPM}$.

Consequently, the cooling water and pressure oil are cooled with optimal energy efficiency. Also, the noise generated by the cooling fan itself is no greater than is necessary. That is, since the cooling fan rotation speed is varied without stages to the rotation speed necessary and sufficient for cooling, the cooling fan rotation speed does not exceed the rotation speed sufficient and necessary for cooling. Consequently, the rotation speed does not increase beyond the rotation speed necessary and sufficient for cooling and there are no energy losses. There is also no noise generated by the cooling fan. Furthermore, since there is no recirculation to the tank due to limiting the flow rate with a flow rate control valve, there are also no energy losses due to excessive flow rates.

Thus with the third invention, when driving a cooling fan with a hydraulic source, it is possible to drive it with optimal energy efficiency and to control noise to a minimum.

Furthermore, with the third invention, since the target fan rotation speed $FAN_{RPM}$ that is necessary and sufficient for cooling is determined for the cooling water or the pressure oil, whichever of the cooling mediums, is insufficiently cool, and the cooling fan 8 is rotated at this target fan rotation speed $FAN_{RPM}$, it is possible to avoid situations where either the cooling water or pressure oil is insufficiently cooled, even when both are cooled by the cooling fan 8.

The fourth invention is a cooling fan drive control device according to the first, second or third invention, wherein:

it comprises a fan rotation speed sensing means 36 which senses the rotation speed of the cooling fan 8, and the capacity control means 47, 40 controls the capacity 2*a* of the hydraulic pump 2 or the hydraulic motor 7 according to the difference between the target fan rotation speed set by the target fan rotation speed setting means 50 and the fan rotation speed sensed by the fan rotation speed sensing means 36.

The fourth invention is described with reference to FIGS. 1(*a*) and 1(*b*).

With the fourth invention, similar advantages are obtained as with the first, second and third inventions.

Furthermore, with the fourth invention, since the capacity 2*a* of the hydraulic pump 2 (or hydraulic motor 7) is controlled so as to eliminate the difference between the target fan rotation speed and the fan rotation speed sensed by the fan rotation speed sensing means 36, it is possible to make the fan rotation speed closely match the fan target rotation speed $FAN_{RPM}$. This further improves the energy efficiency. It also eliminates the occurrence of fluctuations in the controlled object—i.e. the rotation speed of cooling fan 8—due to changes in the efficiency of hydraulic equipment such as the hydraulic pump 2 and the hydraulic motor 7 according to factors such as the pressure oil temperature.

The fifth invention is a cooling fan drive control device which comprises a hydraulic pump 2 driven by a drive source 1, a cooling fan 8 which cools cooling water of the drive source 1, and a hydraulic motor 7 which is operated by pressure oil discharged from the hydraulic pump 2 and causes the cooling fan 8 to rotate, wherein it also comprises:

a capacity control means 47, 40 which controls a capacity 2*a* of the hydraulic pump 2 or the hydraulic motor 7 according to a difference between a temperature of the cooling water and a target temperature.

The fifth invention is described with reference to FIGS. 1(*a*) and 1(*b*) and FIG. 2.

With the fifth invention, the capacity 2*a* of the hydraulic pump 2 (or hydraulic motor 7) is controlled by the capacity control means (controller 47, EPC valve 40) so that the temperature of the cooling water reaches a target temperature.

With the fifth invention, the cooling fan 8 is rotated so that the cooling water reaches a target temperature. Consequently, the efficiency of engine 1 is always the optimal efficiency. And since there is no recirculation to the tank due to limiting the flow rate with a flow rate control valve, there are also no energy losses due to excessive flow rates.

In this way, with the fifth invention, the engine 1 can always be driven with optimal efficiency when the cooling fan is driven by a hydraulic source.

Furthermore, with the fifth invention, unlike the first invention, there is no need to determine a target fan rotation speed $FAN_{RPM}$ for each cooling water temperature $T_c$. That is, there is no need to preset the relationship between each cooling water temperature $T_c$ and each target fan rotation speed $FAN_{RPM}$ for each type of equipment, and one need only determine a common cooling water target temperature for each type of equipment, allowing the work associated with setting computational formulae and/or memory tables to be performed easily.

The sixth invention is a cooling fan drive control device which comprises a hydraulic pump 2 driven by a drive source 1, a cooling fan 8 which cools pressure oil of equipment 43 operated by the drive source 1, and a hydraulic motor 7 which is operated by pressure oil discharged from the hydraulic pump 2 and causes the cooling fan 8 to rotate, wherein it also comprises:

a capacity control means 47, 40 which controls a capacity 2*a* of the hydraulic pump 2 or the hydraulic motor 7 according to a difference between a temperature of the pressure oil and a target temperature.

The sixth invention is arrived at by substituting the cooling fan 8 which cools the cooling water in the fifth invention with a cooling fan 8 which cools the pressure oil.

With the sixth invention, similar advantages are obtained as with the fifth invention.

The seventh invention is a cooling fan drive control device according to the first, second or third invention, wherein:

the capacity control means 47, 40 performs control to gradually change the fan rotation speed of the cooling fan 8 until the fan rotation speed of the cooling fan 8 reaches the target fan rotation speed set by the target fan rotation speed setting means 50.

The seventh invention is described with reference to FIGS. 1(*a*) and 1(*b*).

With the seventh invention, similar advantages are obtained as with the first, second and third inventions.

Furthermore, with the seventh invention the fan rotation speed of cooling fan 8 is gradually changed until the fan rotation speed of cooling fan 8 reaches the target fan rotation speed $FAN_{RPM}$.

Consequently, sharp fluctuations in the fan rotation speed are prevented, and it is possible to prevent damage to the hydraulic equipment, especially the hydraulic motor 7.

The eighth invention is a cooling fan drive control device according to the first, second or third invention, wherein:

it comprises a compensation means 46 which, when the target fan rotation speed set by the target fan rotation speed setting means 50 is greater than or equal to a prescribed limiting rotation speed, compensates the target fan rotation speed to the limiting rotation speed, and the capacity control means 47, 40 controls the capacity 2*a* of the hydraulic pump 2 or the hydraulic motor 7 according to the difference between the fan rotation speed of the cooling fan 8 and the compensated target fan rotation speed compensated by the compensation means 46.

The eighth invention is described with reference to FIGS. 1(*a*) and 1(*b*) and FIG. 2.

With the eighth invention, similar advantages are obtained as with the first, second and third inventions.

Also, with the eighth invention, when the target fan rotation speed (e.g. 1750 rpm) set by a target fan rotation speed setting means 50 is greater than or equal to a prescribed limiting rotation speed (e.g. 1225 rpm), the target fan rotation speed is compensated to this limiting rotation speed (1225 rpm), and the cooling fan 8 is rotated at this compensated target fan rotation speed (1225 rpm).

In this way, since the cooling fan 8 is rotated at a rotation speed not exceeding this prescribed limiting rotation speed, it is possible to suppress the noise to within a fixed level when noise is limited by regulations and the like, and further noise reductions can be achieved.

The ninth invention is a cooling fan drive control device according to first to eighth inventions, wherein:

it performs control to rotate the cooling fan 8 in an opposite rotation direction to a rotation direction when cooling the cooling water or the pressure oil at a prescribed time or at prescribed time intervals.

The ninth invention is described with reference to FIGS. 1(*a*) and 1(*b*).

With the ninth invention, similar advantages are obtained as with the first through eighth inventions.

Furthermore, with the ninth invention, cooling fan 8, which is provided opposite radiator 57 which dissipates heat from the cooling water or pressure oil, rotates in the opposite rotation direction to the rotation direction when cooling the cooling water or pressure oil at a prescribed time or at prescribed time intervals. Consequently, any dead leaves, dust or the like that have been sucked into the radiator 57 are periodically blown out. It is thereby possible to keep the interior of the chamber in which the radiator 57 is accommodated (the interior of the engine room) clean even when operating in environments where dead leaves, dust and the like are present in large quantities.

The tenth invention is a cooling fan drive control device according to the first through ninth inventions, wherein:

the capacity control means 47, 40 performs control to minimize the capacity 2*a* of the hydraulic pump 2 or the hydraulic motor 7 when the drive source 1 is started up.

The tenth invention is described with reference to FIGS. 1(*a*) and 1(*b*).

With the tenth invention, similar advantages are obtained as with the first through ninth inventions.

Furthermore, with the tenth invention, the capacity 2*a* of hydraulic pump 2 (or hydraulic motor 7) is minimized when the drive source (engine) 1 is started up, whereby sharp increases in oil pressure inside a hydraulic duct 42 can be suppressed. Also, since the load on the engine 1 is reduced, the starting properties of the engine 1 are improved.

The eleventh invention is a cooling fan drive control device according to the first through tenth inventions, wherein:

it performs control to increase the rotation speed of the cooling fan 8 to approximately a maximum rotation speed at prescribed time intervals.

The eleventh invention is described with reference to FIGS. 1(*a*) and 1(*b*).

With the eleventh invention, similar advantages are obtained as with the first through tenth inventions.

Also, with the eleventh invention, the rotation speed of cooling fan 8 is increased to approximately the maximum rotation speed at prescribed time intervals. This allows hot gases to be removed from the interior of the chamber in which the cooling fan 8 is accommodated the interior of the engine room, and it is thereby possible to improve the lifetime of components with relatively low heat resistance such as harnesses and hoses.

The twelfth invention is a cooling fan drive control device according to the first through eleventh inventions, wherein:

it comprises an indication means 55 that indicates the target fan rotation speed, and the target fan rotation speed setting means 50 sets a target fan rotation speed corresponding to target fan rotation speed indication details indicated by the indication means 55.

The twelfth invention is described with reference to FIGS. 1(*a*) and 1(*b*).

With the twelfth invention, similar advantages are obtained as with the first through eleventh inventions.

Furthermore, with the twelfth invention, the target fan rotation speed $FAN_{RPM}$ is set by taking into consideration not just the cooling water temperature and the pressure oil temperature, but also the target fan rotation speed indication details indicated by the indication means 55. Consequently, the rotation speed is controlled with greater detail, and it is possible to rotate the cooling fan 8 at a target rotation speed suited to the existing operating conditions, for example. In this way it is possible to further improve the energy efficiency.

The thirteenth invention is a cooling fan drive control device according to the first through twelfth inventions, wherein:

it comprises a hydraulic actuator 4 which is operated by pressure oil discharged from the hydraulic pump 2 being supplied via an operating valve 3, and a pump capacity control valve 20 which changes the capacity 2*a* of the hydraulic pump 2 so that a difference in pressure between a discharge pressure of the hydraulic pump 2 and a load pressure of the hydraulic actuator 4 becomes a desired set pressure difference.

The thirteenth invention is described with reference to FIG. 10.

With the thirteenth invention, similar advantages are obtained as with the first through twelfth inventions.

Furthermore, the hydraulic pump 2 of the thirteenth invention acts as a common hydraulic drive source for the hydraulic actuator 4 and the hydraulic motor 7 that drives the fan.

In a pump capacity control valve 20, load sensing control is performed to set the pressure difference between the discharge pressure P of the hydraulic pump 2 and the signal pressure corresponding to the load pressure PLS of the hydraulic actuator 4 to the desired pressure difference. Furthermore, the cooling fan 8 is rotated at a target fan rotation speed that is necessary and sufficient for cooling the cooling water or pressure oil by a capacity control means 13, 24 which controls the capacity 7*c* of the hydraulic motor 7. Alternatively, the efficiency of engine 1 or hydraulic cylinder 4 is maximized (optimized) by matching the temperature of the cooling water or pressure oil to a target temperature.

By performing this load sensing control and cooling fan rotation speed control (or temperature control) simultaneously, it is possible to increase the overall energy efficiency of the actuators of both the hydraulic actuator 4 and the hydraulic motor 7 used to drive the fan.

BRIEF DESCRIPTION OF THE DRAWINGS

FIG. 1(*a*) is a block diagram of an embodiment mode, and FIG. 1(*b*) shows a modified example of the configuration of a part of FIG. 1(*a*);

DESCRIPTION OF THE PREFERRED EMBODIMENTS

Figure 2:
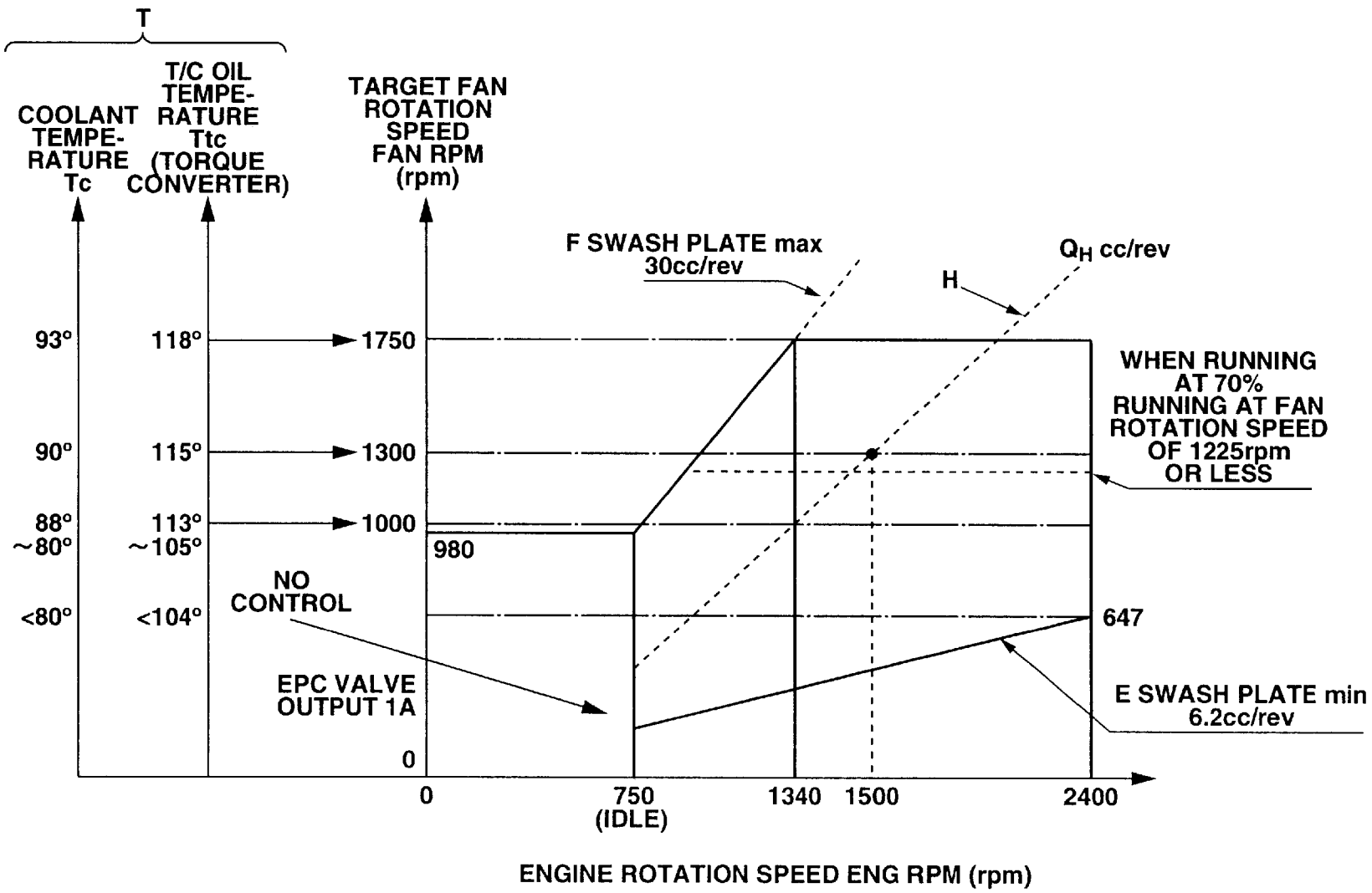
FIG. 2 is a graph used to determine the target fan rotation speed.

Embodiments of cooling fan drive devices relating to the present invention are described below with reference to the figures.

FIG. 1 (*a*) shows a block diagram of an embodiment mode.

The hydraulic circuit and controller shown in this FIG. 1(*a*) are incorporated into construction machinery such as a hydraulic shovel. When it is applied to construction machinery, the variable capacity hydraulic pump 2 shown in FIG. 1(*a*) may, although not shown in particular in the figure, be a hydraulic supply source that supplies pressure oil to a hydraulic cylinder that drives a boom, for example.

The variable capacity hydraulic pump 2 is the hydraulic drive source of the cooling fan 8.

The variable capacity hydraulic pump 2 is driven by an engine 1 as a drive source. The engine 1 is provided with an engine rotation speed sensor 44 which senses the rotation speed $N_e$ of the engine 1, i.e. the input rotation speed $N_e$ of the hydraulic pump 2. For the rotation speed sensor 44 it is possible to use, for example, a pulse pick-up. Here, in a hydraulic system where a fixed capacity hydraulic pump is simultaneously driven by the engine 1, it is also possible to provide a fixed constriction in the output duct of the fixed capacity hydraulic pump instead of the rotation speed sensor 44, and to sense the rotation speed of engine 1 by sensing the difference in pressure either side of this fixed constriction.

The hydraulic pump 2 is configured from a swash plate style piston pump for example. The displacement (capacity) $Q_{ccrev}$ (cc/rev) of the hydraulic pump 2 varies according to changes in the swash plates 2*a* of the hydraulic pump 2.

The displacement (capacity) of the hydraulic pump 2 is varied by operating a servo piston 21.

The hydraulic pump 2 draws pressure oil into the interior of tank 9 and discharges pressure oil from a pressure oil outlet. The pressure oil discharged by the hydraulic pump 2 is supplied via a duct 42 to the inlet part of fan drive hydraulic motor 7. The hydraulic motor 7 is a fixed capacity hydraulic motor.

Figure 10:
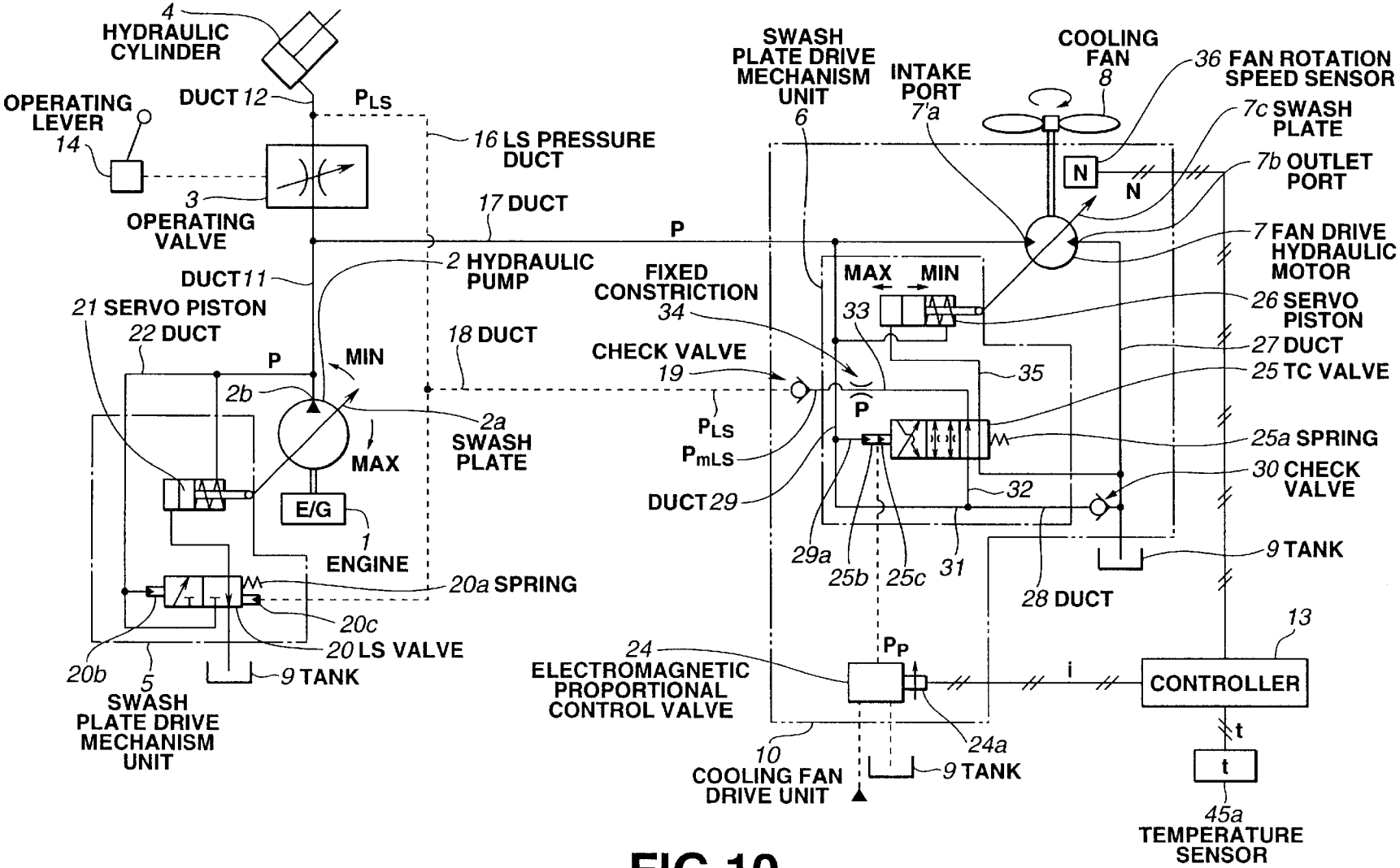
FIG. 10 is a hydraulic circuit diagram showing an embodiment of a cooling fan drive device relating to the present invention.

A cooling fan 8 is attached to the output shaft of the hydraulic motor 7. A fan rotation speed sensor which senses the rotation speed N of cooling fan 8 may be installed on the abovementioned output shaft of the hydraulic motor 7. For example, a fan rotation speed sensor 36 can be provided as shown in FIG. 10.

The hydraulic motor 7 is rotationally driven by the pressure oil discharged from the hydraulic pump 2 flowing in from the inlet port, thereby causing the cooling fan 8 to rotate. The pressure oil that is made to flow out from the outlet part of the hydraulic motor 7 is returned to the tank 9 through a duct 42*a*.

In the present embodiment mode, a switching valve 65 which switches the rotation direction of the hydraulic motor 7 is provided in ducts 42 and 42*a*. This switching valve 65 is switched either by operating an operating lever 66 or according to a signal output from a hydraulic drive controller 47 which is described below. When switching valve 65 is switched from the switching position in FIGS. 1(*a*) and 1(*b*), the cooling fan 8 rotates in the normal direction, and when it is in the switching position shown in FIGS. 1(*a*) and 1(*b*), the cooling fan 8 rotates in the reverse direction. That is, when the switching valve 65 is switched downward, the pressure oil flow direction is switched with respect to the hydraulic motor 7, and the hydraulic motor 7 rotates in the normal direction. Accordingly, the cooling fan 8 rotates in the normal direction. Note that it is also possible to change the rotation direction of the cooling fan 8 by configuring the hydraulic circuit as shown in FIG. 1(*b*).

In the hydraulic circuit shown in this FIG. 1(*b*), instead of a hydraulic pump 2, a hydraulic pump 2*b* that is capable of two-directional flow can be used. The hydraulic pump 2*b* is a swash plate type whereby the discharge outlet which discharges the pressure oil is switched due to the swash plate being changed, and the pressure oil inflow direction with respect to hydraulic motor 7 is switched. In this way the rotational direction of the cooling fan 8 can be switched to direction A1 or the reverse direction A2. Note that the hydraulic pump 2*b* may also be an oblique shaft type.

The coolant (cooling water) that is the cooling medium of engine 1 is guided to a radiator 57 which acts as a heat dissipater. In the radiator 57, the heat held by the coolant is dissipated. The cooling fan 8 is provided opposite the radiator 57.

Accordingly, the coolant is cooled due to the rotation of cooling fan 8. In the radiator 57, a temperature sensor 23 is provided which senses the temperature $T_c$ of the coolant.

A torque converter 43 is operated by the engine 1. The torque converter 43 is provided with a temperature sensor 45 which senses the temperature of the pressure oil in the torque converter 43, i.e. the torque converter (T/C) oil temperature $T_{tc}$.

The oil discharged from the pressure oil pump 2 is supplied to a hydraulic cylinder (not illustrated). The hydraulic cylinder is operated by this pressure oil. The abovementioned temperature sensor 45 may also be used as a sensor that senses the temperature of the pressure oil in the hydraulic cylinder. Instead of sensing the oil temperature in the torque converter 43, it is possible to sense the oil temperature in the hydraulic cylinder.

The pressure oil inside such a torque converter or hydraulic cylinder is guided to an oil cooler.

Figure 14:
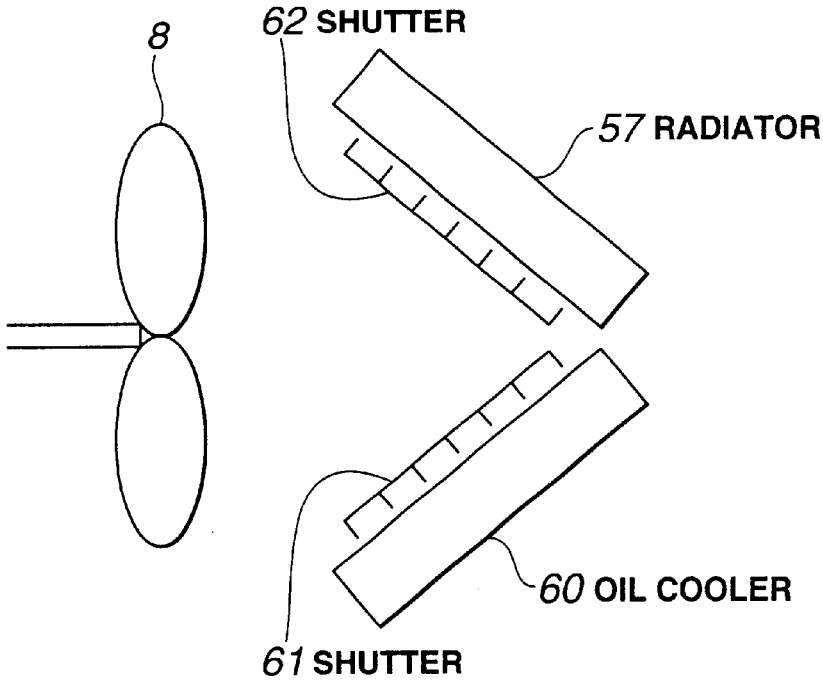
FIG. 14 shows the positional relationship of the radiator, oil cooler and cooling fan in an embodiment mode.
Figure 15:
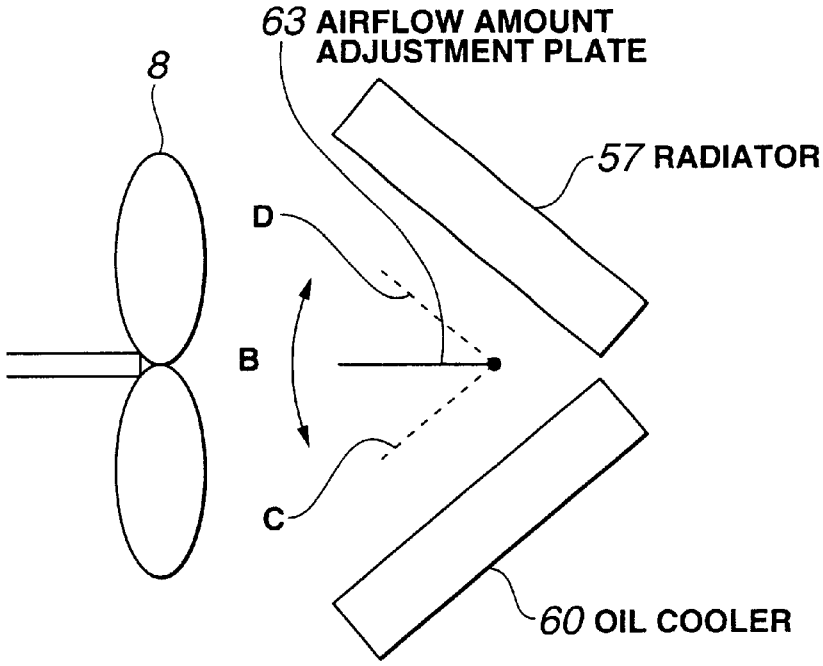
FIG. 15 shows the positional relationship of the radiator, oil cooler and cooling fan in an embodiment mode.

FIGS. 14 and 15 show the positional relationship of the cooling fan 8, radiator 57 and oil cooler 60.

The oil cooler 60 is provided opposite the cooling fan 8 in the same way as the radiator 57. Consequently, the pressure oil is cooled by a flow of air generated by the rotation of the cooling fan 8.

In FIG. 14, shutters 61 and 62 which block the flow of air produced by the cooling fan 8 are respectively provided on the heat-dissipating surfaces of the radiator 57 and oil cooler 60.

Also in FIG. 15, an airflow amount adjustment plate 63, which adjusts the amount of airflow generated by the cooling fan 8 and guided to the heat dissipating surfaces of radiator 57 and oil cooler 60, is provided at the heat dissipating surfaces of radiator 57 and oil cooler 60. The airflow amount adjustment plate 63 can be inclined as shown by arrow B. If the airflow amount adjustment plate 63 is inclined to position C, then the flow of air toward the heat dissipating surfaces of the oil cooler 60 is more or less cut off and only the radiator 57 is cooled. Also if the airflow amount adjustment plate 63 is inclined to position D, then the flow of air toward the heat dissipating surfaces of the radiator 57 is more or less cut off and only the oil cooler 60 is cooled.

When the construction machinery assumed in the present embodiment mode is a hydraulic shovel or the like, the control panel inside the driver's cabin is provided with an operation mode selection switch which selects any of the operating modes M from among each of the types of operation performed by the hydraulic shovel, i.e. each of its operating modes. In this embodiment mode, an operating mode selector switch 55 is used to select a heavy-load-carrying mode when performing heavy-load-carrying work, and to select a light-load-carrying mode when performing light-load-carrying work. In the heavy-load-carrying mode, the amount of heat generated by the engine 1 is greater than in the light-load-carrying mode, and the stream of air produced by the cooling fan 8 must be increased.

A signal SM indicating the operating mode M selected by the operating mode selection switch 55 is input to a vehicle control controller 56. The vehicle control controller 56 is a vehicle control controller that performs various types of control such as controlling the rotation speed of the engine 1 and the fuel injection rate so that the rotation speed of the engine 1 and the torque of engine 1 are respectively the target engine rotation speed and the target engine torque. The details of the control performed by the vehicle control controller 56 do not relate directly to the purport of the present invention, and are not described here.

Vehicle control controller 56 is provided with a communication interface 56*a* in order to send and receive data between other controllers within the vehicle.

On the other hand, a hydraulic drive fan controller 47 (abbreviated to controller 47 hereafter) is provided in order to control the flow of air generated by the hydraulic drive cooling fan 8 as mentioned above. The controller 47 is also provided with a similar communication interface 47*a*. A signal line 64 connects between these communication interfaces 56*a* and 47*a*. Data in prescribed data quantities can thereby be serially transmitted as a frame signal with a prescribed protocol between controllers 56 and 47 via the signal line 64. Accordingly, a frame signal which states the operating mode M selected by the operating mode selection switch 55 is input to the controller 47 via the signal line 64.

The controller 47 is provided with a rotation speed limiting switch 46 which is operated when limiting the rotation speed of the cooling fan 8 to 70% of the maximum rotation speed. When the rotation speed limiting switch 46 is operated, the rotation speed of the cooling fan 8 is limited to 70% of the maximum rotation speed, so a rotation speed limiting signal S70 is input to the controller 47. The controller 47 is input with the following signals: the detected coolant temperature $T_c$ of the temperature sensor 23, the detected torque converter oil temperature $T_{tc}$ of the temperature sensor 45, the detected engine rotation speed $N_e$ of the engine rotation speed sensor 44, the operating mode selection signal SM indicating the operating mode M selected by the operating mode selection switch 55, and the rotation speed limiting signal S70 indicating that the rotation speed limiting switch 46 has been operated. It is also input with the detected fan rotation speed N of the fan rotation speed sensor 36 (FIG. 10).

The controller 47 generates a command current i based on these input signals, and by applying this command current to the electromagnetic solenoid 40*a* of the electromagnetic proportional control valve 40 (abbreviated to EPC valve 40 in the following), the valve position of this EPC valve 40 is changed and the swash plate 2*a* (capacity) of the hydraulic pump 2 is driven and controlled.

The servo piston 21 is a capacity control member which varies the swash plate angle and drives the swash plate 2*a* of the hydraulic pump 2. The servo piston 21 moves to the inclined rotation angle of the swash plate 2*a,* i.e. the position corresponding to the displacement $Q_{ccrev}$ of the hydraulic pump 2.

The EPC valve 40 is a valve that is switched according to an input electrical command i either to a valve position in which pressure oil (pressure oil discharged from hydraulic pump 2) is supplied to the large diameter side of the servo piston 21, or to a valve position in which the pressure oil is discharged into a tank 9 from the large diameter side of the servo piston 21.

The EPC valve 40 is a control valve whose valve position is changed by applying the command current i output from the controller 47 to the electromagnetic solenoid 40*a,* and which applies the output pressure to the large diameter hydraulic oil chamber of the servo piston 21 corresponding to the current value i.

Figure 8A:
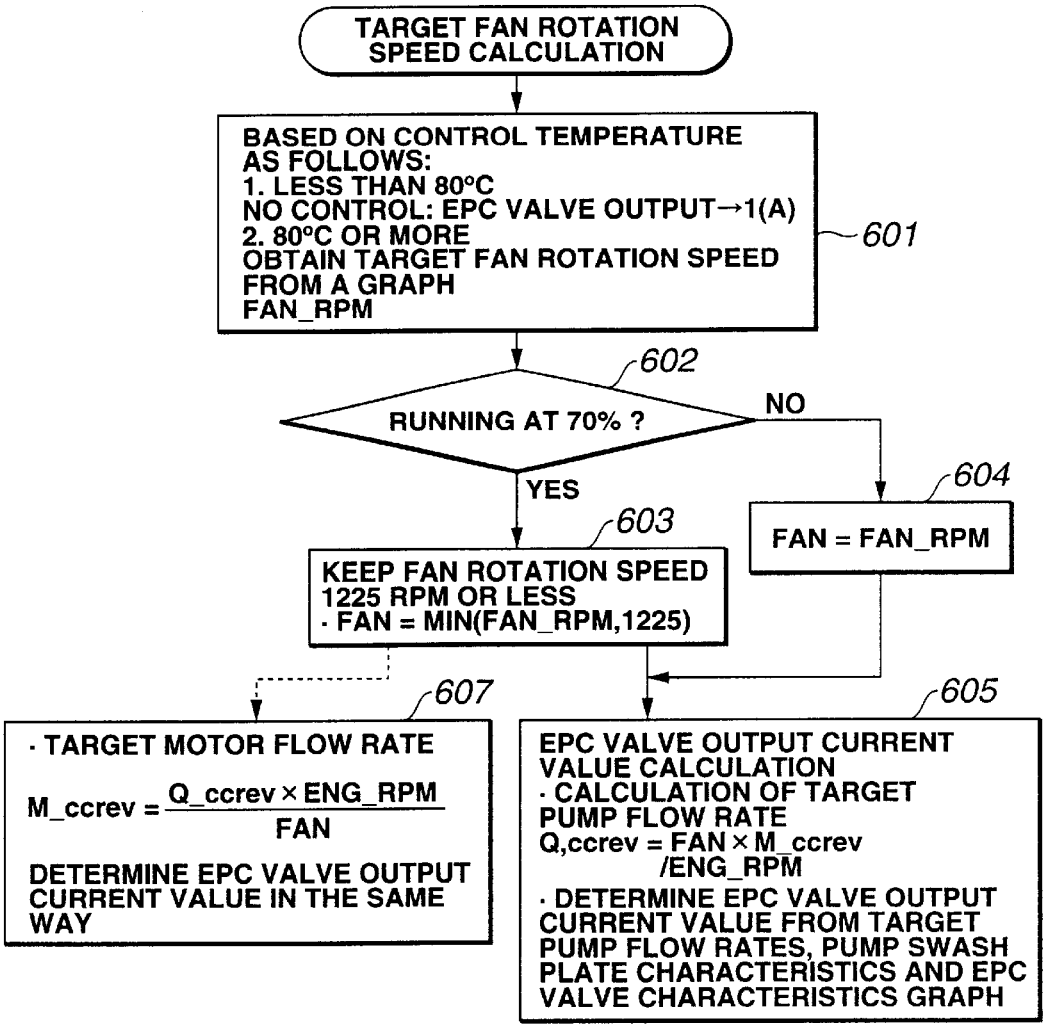
FIG. 8(*a*) shows the target fan rotation speed calculation processing procedure in FIG. 5, and FIG. 8(*b*) is a graph used to determine the command current value from the pump target flow rate.
Figure 8B:
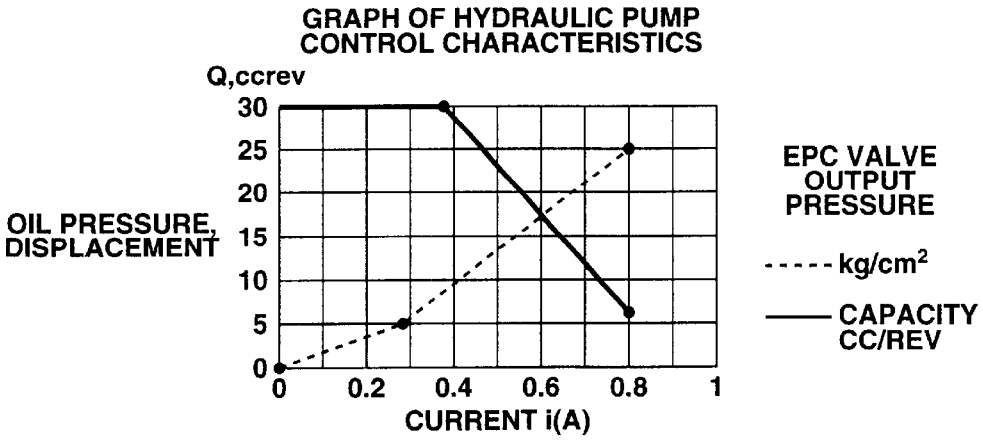

FIG. 8(*b*) shows the relationship between the command current i, the pump displacement $Q_{ccrev}$ and the output pressure of EPC valve 40 in the embodiment mode.

As this FIG. 8(*b*) shows, as the command current value i applied to EPC valve 40 increases, the oil pressure output from the EPC valve 40 to the large diameter side of the servo piston 21 increases as shown by the dotted line. Also, as the command current value i applied to the EPC valve 40 increases, the displacement (clearance) $Q_{ccrev}$ of the hydraulic pump 2 becomes smaller as shown by the solid line.

In this way, by outputting the command current i to the EPC valve 40 corresponding to the displacement $Q_{ccrev}$ of the hydraulic pump 2 from the controller 47, the flow rate $Q_{ccrev}$ discharged per cycle from the hydraulic pump 2 is controlled. Accordingly, the flow rate of the pressure oil supplied to the hydraulic motor 7 is controlled, and the rotation speed of the cooling fan 8 is controlled.

Next, the processing performed by the controller 47 shown in FIGS. 1(*a*) and 1(*b*) is described with reference to the flowcharts shown in FIGS. 3 through 9.

Figure 3:
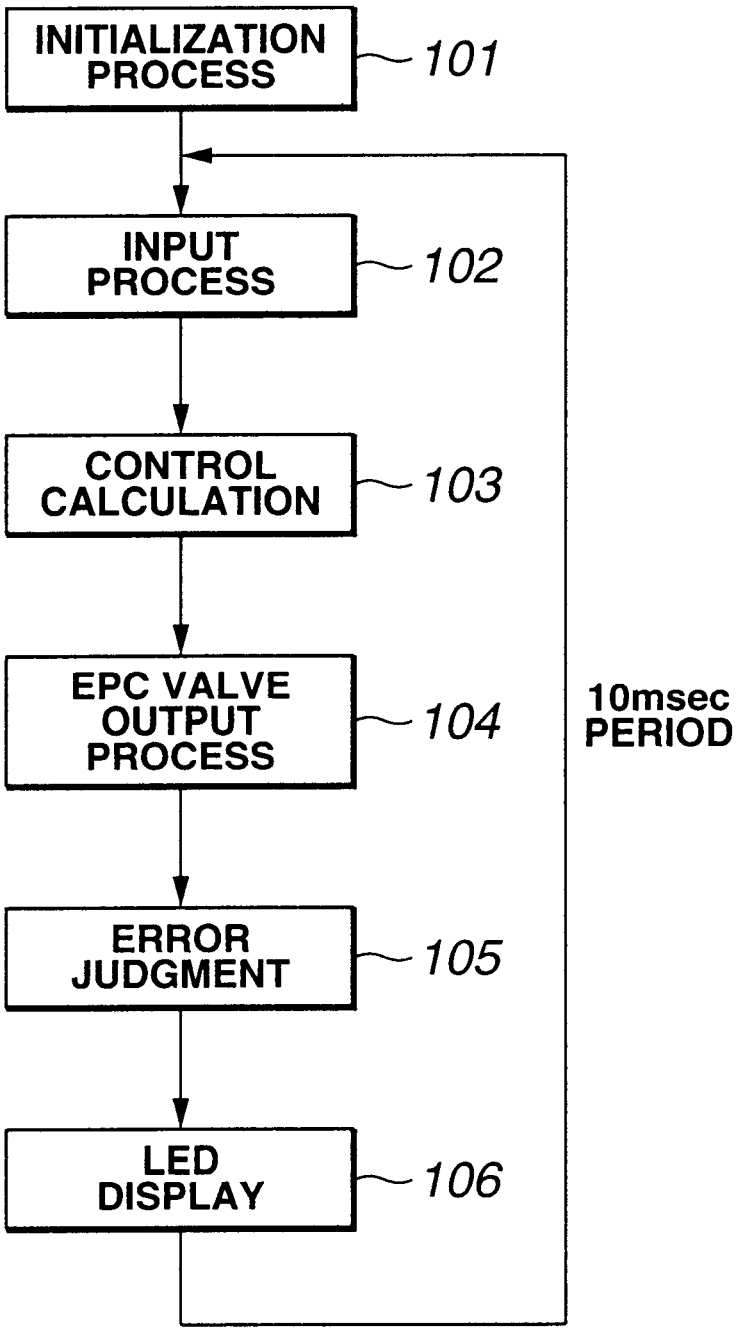
FIG. 3 shows the overall processing procedure of the control performed by the controller in FIGS. 1(*a*) and 1(*b*)

An overall summary of the processing performed by the controller 47 is shown in FIG. 3.

Figure 4:
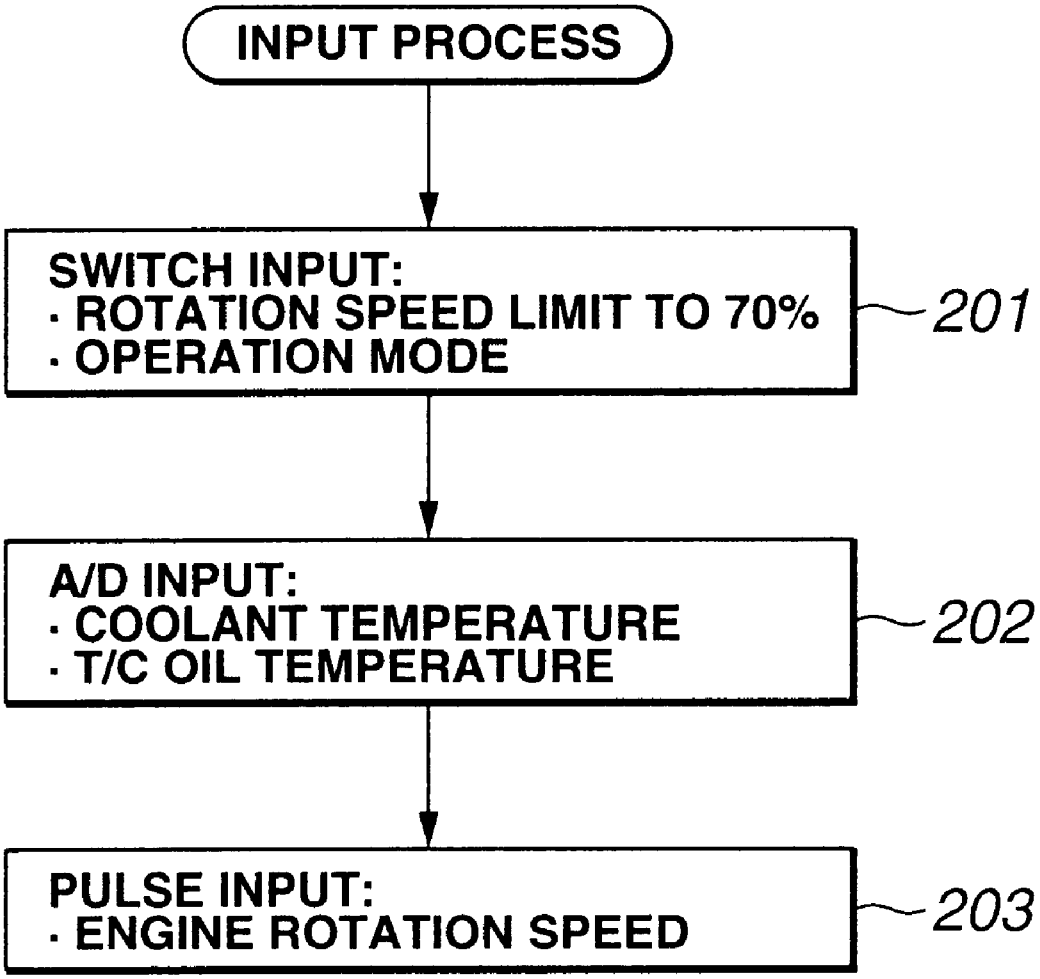
FIG. 4 shows the input processing procedure of FIG. 3.
Figure 5:
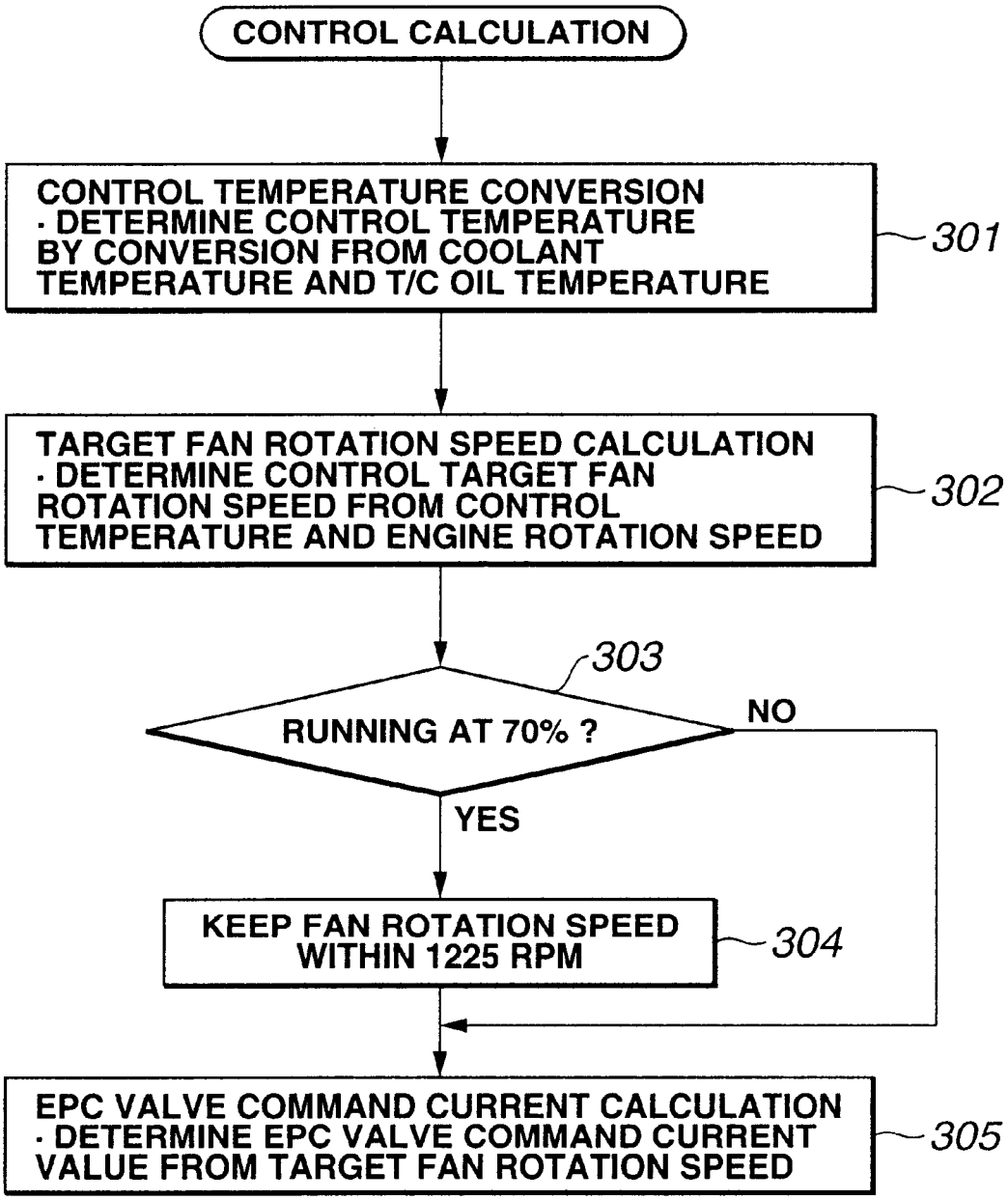
FIG. 5 shows the control calculation procedure in FIG. 3.
Figure 6:
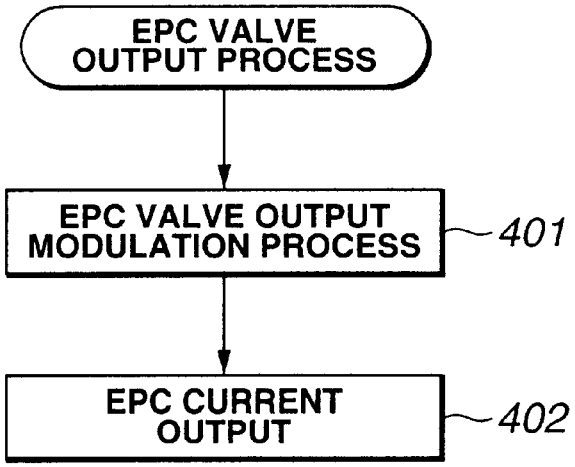
FIG. 6 shows the EPC value output processing procedure in FIG. 3.
Figure 7:
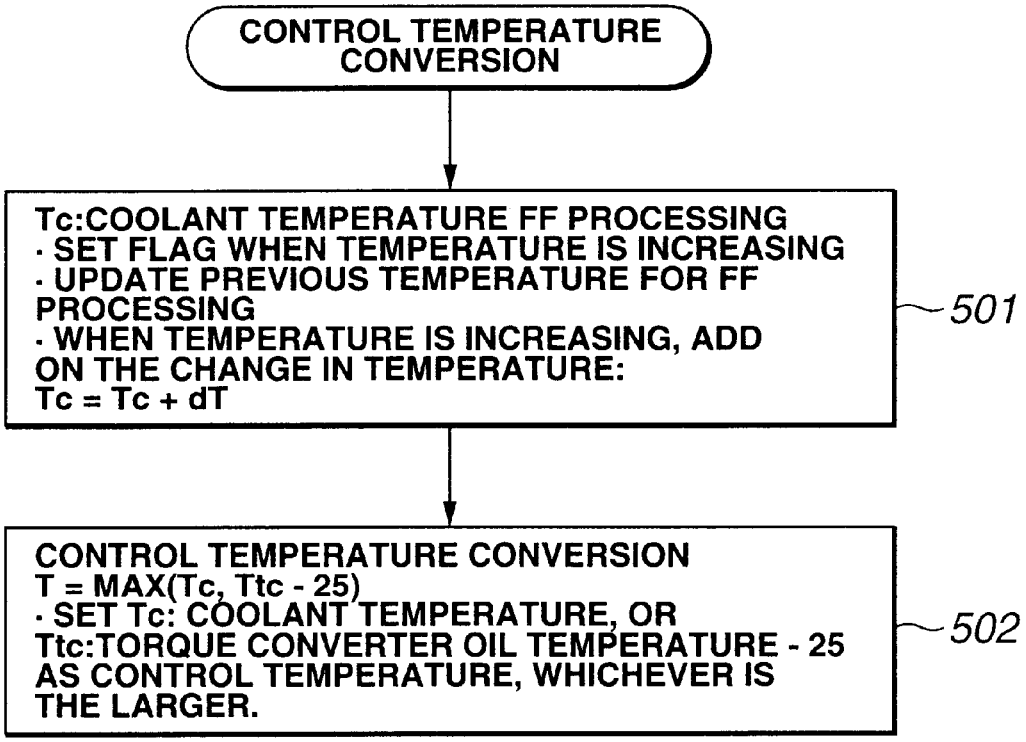
FIG. 7 shows the control temperature conversion processing procedure in FIG. 5.

After the initial processing (step 101) has been performed, the input processing of steps 201–203 shown in FIG. 4 is performed at the input processing (step 102). On completion of the input processing (step 102), the control calculation processing of steps 301–305 as shown in FIG. 5 is performed at the control calculation (step 103). On completion of the control calculation (step 103), the EPC valve output process of steps 401–402 shown in FIG. 6 is performed at the EPC valve output processing (step 104). On completion of the EPC valve output processing (step 104), a judgment is made as to whether or not any errors have occurred during the processing (step 105), and when an error has occurred, the fact that an error has occurred is displayed by an LED (step 106). The processing of the abovementioned steps 102–106 is repeatedly performed in a cycle of 10 msec for example.

As shown in FIG. 4, when the input processing (step 102) is started, the rotation speed limiting signal S70—which is input into the controller 47 by the operating rotation speed limiting switch 46—is input to the target fan rotation speed calculation unit 50. Also, an operating mode selection signal SM indicating the operating mode M selected by the operating mode selection switch 55 is input to the target fan rotation speed calculation unit 50 via a communication interface 47*a* (step 201).

Next, the coolant temperature detection signal $T_c$ and the torque converter oil temperature detection signal $T_{tc}$ are converted from analog signals into digital signals by an A/D converter 51 in the controller 47, and are input to a control temperature conversion unit 52 (step 202).

Next the pulses showing the engine rotation speed in a detection signal $N_e$ are counted by a pulse counter 48, and in an engine rotation speed conversion unit 49 they are subjected to engineering unit conversion into an engineering rotation speed $ENG_{RPM}$ with a value corresponding to the size of the counted value, which is input to the target fan rotation speed calculation unit 50 (step 203).

When the control calculation (step 103) is started, a control temperature conversion process is performed (step 301). The control temperature conversion is performed by the control temperature conversion unit 52 according to the procedure shown in FIG. 7.

In addition to performing compensation by a feedback process with respect to the detected coolant temperature $T_c$ detected at each prescribed sampling time, the compensation is calculated as the existing coolant temperature $T_c$ (step 501).

At step 501, the difference dT between the detected coolant temperature $T_{c-}$ detected at the previous sampling time and the detected coolant temperature $T_{c+}$ currently being sampled is obtained, whereby a judgment is made as to whether or not the coolant temperature $T_c$ is rising. When it is judged that the coolant temperature $T_c$ is rising, a flag is set to show that the temperature is rising.

Once the sampling time has elapsed the sensing of the temperature $T_{c+}$, the contents of $T_{c-}$ are updated by the contents of $T_{c+}$, and the contents of $T_{c-}$ are deleted.

Therefore, when the abovementioned flag is set to indicate a rise in temperature, the existing coolant temperature $T_c$ is calculated by the following calculation formula (1).

$$T_c = T_{c+} + dT \quad (1)$$

(step 501)

Note that it is also possible to determine the existing coolant temperature without performing a feed-forward process.

Next, in the control temperature conversion unit 52, the calculation of formula (2) below is performed based on the coolant temperature $T_c$ determined in formula 1 above and the detected torque converter oil temperature $T_{tc}$, whereby the control temperature T is determined to be either the coolant temperature $T_c$ or the temperature obtained by subtracting 25° C. from the detected torque converter oil temperature $T_{tc}$, whichever is the larger.

$$T = \mathrm{MAX}\, T_c, (T_{tc}, T_c - 25°) \quad (2)$$

The above formula (2) takes into consideration the fact that there is a difference due to the heat balance of 25° C. between the coolant temperature and the torque converter oil temperature. The value of 25° C. for the above difference is only given as an example, and the present invention is not limited to this value. The control temperature T determined in the above way is input to the target fan rotation speed calculation unit 50 (step 502).

On completing the abovementioned control temperature conversion processing (step 301), the series of calculation processing below the target fan rotation speed calculation process is then performed (steps 302 through 305). The calculation processing sequence that follows this target fan rotation speed calculation process is performed by the target fan rotation speed calculation unit 50 according to the procedure shown in FIG. 8(*a*).

FIG. 2 shows a graph used to determine the target fan rotation speed $FAN_{RPM}$ from the control temperature T. FIG. 2 also shows a graph used to determine the displacement $Q_{ccrev}$ of the hydraulic pump 2 from the target fan rotation speed $FAN_{RPM}$.

That is, as FIG. 2 shows, in the vertical axis of the graph, the target fan rotation speed $FAN_{RPM}$ is set corresponding to the control temperature $T=(\mathrm{MAX}(T_c, T_{tc}-25°))$. The engine rotation speed $ENG_{RPM}$ is plotted on the horizontal axis of the graph. The displacement $Q_{ccrev}$ of hydraulic pump 2 is determined according to the value of the engine rotation speed $ENG_{RPM}$ on the horizontal axis and the value of the target fan rotation speed $FAN_{RPM}$ on the vertical axis. Note that the values shown on the vertical and horizontal axes in FIG. 2 are only given as examples, and the present invention is not limited to these values.

In FIG. 2, line E is the line at which the displacement $Q_{ccrev}$ of hydraulic pump 2 becomes the minimum displacement (minimum capacity) (6.2 cc/rev). Also, line F is the line at which the displacement $Q_{ccrev}$ of hydraulic pump 2 becomes the maximum displacement (maximum capacity) (30 cc/rev). Note that the above values of the minimum capacity and maximum capacity are only given as examples and the present invention is not limited to these values.

The contents of the graph in FIG. 2 are stored in a prescribed memory in the form of computational formulae or a stored table. When the data is stored in the form of a stored table, data that is not stored can be calculated by an interpolation computation process.

In step 601 of FIG. 8(*a*), a judgment is first made as to whether or not the control temperature T obtained in formula (2) above is less than 80° C. When the control temperature is less than 80° C., it is assumed that the engine 1 (the cooling of torque converter 43) is being cooled adequately, and no control target value $FAN_{RPM}$ is set for the rotation speed of the cooling fan 8. That is, it is judged that no control is to be applied to the rotation speed of the cooling fan 8, and line E—which corresponds to the minimum capacity (minimum volume) (6.2 cc/rev)—is selected so that the swash plate 2*a* of the hydraulic pump 2 is set to the minimum inclination angle (see FIG. 2).

Consequently, from the graph of FIG. 8(*b*), the command current value i at which the displacement $Q_{ccrev}$ of hydraulic pump 2 is set to the minimum volume is given as 1 (A (Ampere)). Note that the numerical values on the vertical and horizontal axes in FIG. 8(*b*) are only given as examples, and the present invention is not limited to these values.

On the other hand, when the control temperature T is 80° C. or more, the target fan rotation speed $FAN_{RPM}$ corresponding to the control temperature T(=MAX($T_c$, $T_{tc}$−25°)) is found according to the graph shown in FIG. 2 (step 601).

Next, a judgment is made as to whether or not the rotation speed limiting signal S70 is being input due to operation of the rotation speed limiting switch 46, i.e. whether or not the rotation speed of the cooling fan 8 should be set to a rotation speed of 70% (1225 rpm) of the maximum rotation speed (1750 rpm) (step 602).

When it is judged, as a result, that the rotation speed limiting signal S70 is being input, the target fan rotation speed FAN is finally determined from formula (3) below.

$$FAN=MIN(FAN_{RPM}, 1225) \quad (3)$$

As shown in formula (3) above, the final target fan rotation speed FAN is taken as the smaller rotation speed of the target fan rotation speed $FAN_{RPM}$ corresponding to the control temperature T and the rotation speed of 1225 rpm which is 70% of the maximum fan rotation speed (1750 rpm). That is, in the graph of FIG. 2, if the rotation speed limiting signal S70 is input, the final target rotation speed $FAN_{RPM}$ is forcibly reduced to line G or below (step 603).

On the other hand, if it is judged that the rotation speed limiting signal S70 is not being input, the target fan rotation speed FAN is finally determined from formula (4) below.

$$FAN=FAN_{RPM} \quad (4)$$

As shown in formula (4) above, the final target fan rotation speed FAN is taken to be the target fan rotation speed FANRpM corresponding to the control temperature T (step 604).

For example, in FIG. 2 when the target fan rotation speed $FAN_{RPM}$ corresponding to the control temperature T is 1300 rpm and the rotation speed limiting signal S70 is input, the final target fan rotation speed FAN is set to 1225 rpm. However, when the target fan rotation speed $FAN_{RPM}$ corresponding to the control temperature T was 1000 rpm, the final target fan rotation speed FAN is left at this value of the rotation speed $FAN_{RPM}$ (=1000 rpm) regardless of whether or not the rotation speed limiting signal S70 is input.

There are a variety of different ways in which the target fan rotation speed FAN can be set according to the control temperature T.

The efficiency of hydraulic equipment varies according to the temperature of the oil. For example, when a hydraulic cylinder is operated with the hydraulic pump 2 as a drive source, it is envisaged that the oil temperature will rise due to the operation of the hydraulic cylinder. At this time, the increased temperature of the oil causes the efficiency of the hydraulic pump 2 and hydraulic motor 7 to decrease, and as a result the actual rotation speed of the cooling fan 8 falls below the target rotation speed. Therefore, to avoid this reduction in the actual fan rotation speed, a pressure oil temperature detection sensor can be provided to sense the temperature of the pressure oil in the hydraulic cylinder, and the target fan rotation speed FAN can be pre-increased according to any increase in the pressure oil temperature as detected by this pressure oil temperature detection sensor. By setting the target fan rotation speed FAN to a value that has been compensated by the detected value of the pressure oil temperature detection sensor, it is possible to keep the actual rotation speed of the cooling fan 8 correct even if there is a decrease in the efficiency of the hydraulic equipment. Note that the torque converter may also be cooled independently and separately.

Also, when the cooling fan 8 is provided with the fan rotation speed sensor 36 shown in FIG. 10, the difference between the target fan rotation speed FAN and the fan rotation speed N detected by fan rotation speed sensor 36 may be determined with the actual fan rotation speed N detected by the fan rotation speed sensor 36 as a feedback signal, and swash the plate 2*a* of hydraulic pump 2 can be controlled so that this difference is eliminated. By performing feedback control in this way, the actual fan rotation speed of the cooling fan 8 can be made to accurately match the target fan rotation speed FAN. Since the rotation speed of the controlled object—cooling fan 8—is subjected to feedback control in this way, it is possible to avoid circumstances in which fluctuations in the rotation speed of the controlled object—cooling fan 8—occur due to reduction in the efficiency of hydraulic machinery such as the hydraulic pump 2 and hydraulic motor 7.

Also, in the present embodiment, when the rotation speed limiting signal S70 is input from the rotation speed limiting switch 46, the target fan rotation speed FAN is always set to 70% or less of the maximum rotation speed. In this way, low-noise operation can be achieved. However, when the actual coolant detection temperature $T_c$ has increased to a temperature that is in a dangerous region in terms of heat balance, it enters a state in which the cooling is insufficient. Therefore a prescribed threshold value is preset in the coolant temperature, and when the actual coolant temperature has reached this threshold value, the abovementioned low-noise operation is forcibly canceled (i.e. rotation speed limiting signal S70 is turned off), and the target fan rotation speed $FAN_{RPM}$ (e.g. 1300 rpm) corresponding to the actual detected coolant temperature $T_c$ (control temperature T) can be set directly as the final target fan rotation speed FAN.

Also, in the present embodiment described above, according to the graph shown in FIG. 2, the target fan rotation speed $FAN_{RPM}$ is principally determined from only the control temperature T.

Here, as the rotation speed of engine 1 increases, the noise produced by the engine 1 also increases. As the noise produced by the engine 1 increases, even if the rotation speed of cooling fan 8 has slightly increased, the noise produced by cooling fan 8 becomes less noticeable to operators and the like. Increasing the rotation speed of the cooling fan 8 as the rotation speed of the engine 1 increases also increases the cooling performance and improves the heat balance.

Therefore with respect to the target fan rotation speed $FAN_{RPM}$ determined principally from the control temperature T, it is also possible to set the target fan rotation speed $FAN_{RPM}$ by adding a correction so that the rotation speed is increased as the rotation speed increases. For example, in FIG. 2 when the coolant temperature $T_c$ (control temperature T) is 80°–88° C. and the rotation speed $ENG_{RPM}$ of engine 1 is 750 rpm, the target fan rotation speed $FAN_{RPM}$ is set to 1000 rpm. On the other hand, when the rotation speed $ENG_{RPM}$ of engine 1 is 2400 rpm, the target fan rotation speed $FAN_{RPM}$ could be set to 1100 rpm by application of a compensation to increase it by 100 rpm.

The target fan rotation speed $FAN_{RPM}$ can also be corrected according to the operating mode selection signal SM indicating the operating mode M selected by the operating mode selection switch 55.

When the operating mode M is the heavy-load-carrying mode, the amount of heat generated by the engine 1 is large, so it is possible to set the target fan rotation speed $FAN_{RPM}$ by applying compensation to the target fan rotation speed $FAN_{RPM}$ obtained from the control temperature T so as to increase it by a prescribed rotation speed. And when the operating mode M is the light-load-carrying mode, the amount of heat produced by engine 1 is small, so it is possible to set the target fan rotation speed $FAN_{RPM}$ by applying compensation to the target fan rotation speed $FAN_{RPM}$ obtained from the control temperature T so as to decrease it by a prescribed rotation speed.

For example, in FIG. 2 when the coolant temperature $T_c$ (control temperature T) is 90° C. and the heavy-load-carrying mode is selected, the target fan rotation speed $FAN_{RPM}$ could be increased by 200 rpm from the normal value of 1300 rpm to 1500 rpm. On the other hand, when the light-load-carrying mode is selected, the target fan rotation speed $FAN_{RPM}$ could be decreased by 200 rpm from the normal value of 1300 rpm to 1100 rpm If the target fan rotation speed FAN is determined in this way, the process for determining the target swash plate tilting angle of the hydraulic pump 2, i.e. the target flow rate $Q_{ccrev}$ per cycle, is performed in a pump swash plate angle calculation unit 53. Specifically, the target flow rate $Q_{ccrev}$ of the hydraulic pump 2 is calculated according to formula (5) below.

$$Q_{ccrev}=\mathrm{FAN}\cdot M_{ccrev}/\mathrm{ENG}_{RPM} \tag{5}$$

As shown in Formula (5) above, the target flow rate $Q_{ccrev}$ of the hydraulic pump 2 is determined based on the target fan rotation speed FAN, the fixed capacity value $M_{ccrev}$ of the hydraulic pump 7, and the rotation rate $ENG_{RPM}$ of the engine 1.

Then, based on the correspondence relationship shown in FIG. 8(*b*), a command current value i is determined corresponding to the target flow rate $Q_{ccrev}$ obtained from formula (5) above.

The graph of FIG. 2 shows the characteristics when the fixed capacity $M_{ccrev}$ of the hydraulic motor 7 is known. For example, when the target fan rotation speed FAN is 1300 rpm and the rotation speed $ENG_{RPM}$ of the engine 1 is 1500 rpm, line H is selected and the capacity $Q_H$ corresponding to this line H is determined as the target flow rate $Q_{ccrev}$ of the hydraulic pump 2 (step 605).

Incidentally in the present embodiment mode, although the hydraulic pump 2 is assumed to be a variable-capacity type and the hydraulic motor 7 is assumed to be a fixed-capacity type, the air flow rate of the cooling fan 8 can be controlled by varying the swash plate (capacity) of the hydraulic motor 7 in the same way even when the hydraulic pump 2 is a fixed-capacity type and hydraulic motor 7 is a variable-capacity type.

In this case, after the processing of step 603 has been completed, it moves on to the processing of step 607.

The target flow rate $M_{ccrev}$ per cycle of the variable capacity motor 7 is then calculated by formula (6) below.

$$M_{ccrev}=Q_{ccrev}\cdot\mathrm{ENG}_{RPM}/\mathrm{FAN} \tag{6}$$

According to Formula 6 above, the target flow rate $M_{ccrev}$ of hydraulic motor 7 is determined based on the target fan rotation speed FAN, the fixed capacity value $Q_{ccrev}$ of the fixed capacity hydraulic pump 2, and the rotation rate $ENG_{RPM}$ of the engine 1.

Then, based on the correspondence relationship shown in FIG. 8(*b*), the command current value i is determined corresponding to the target flow rate $M_{ccrev}$ obtained from formula (6) above (step 607).

The above processing constitutes the control computation (step 103). Once the above control computation processing (step 103) has been completed, the EPC valve output process is then performed (step 104). The EPC valve output process is performed by an EPC valve output conversion unit 54 according to the procedure shown in FIG. 6.

First a modulation process (step 401) and an EPC valve current output process are performed (step 402). Details of the modulation and EPC valve current output processes are shown in FIG. 9(*a*).

Figures 9B, 9C, 9D:
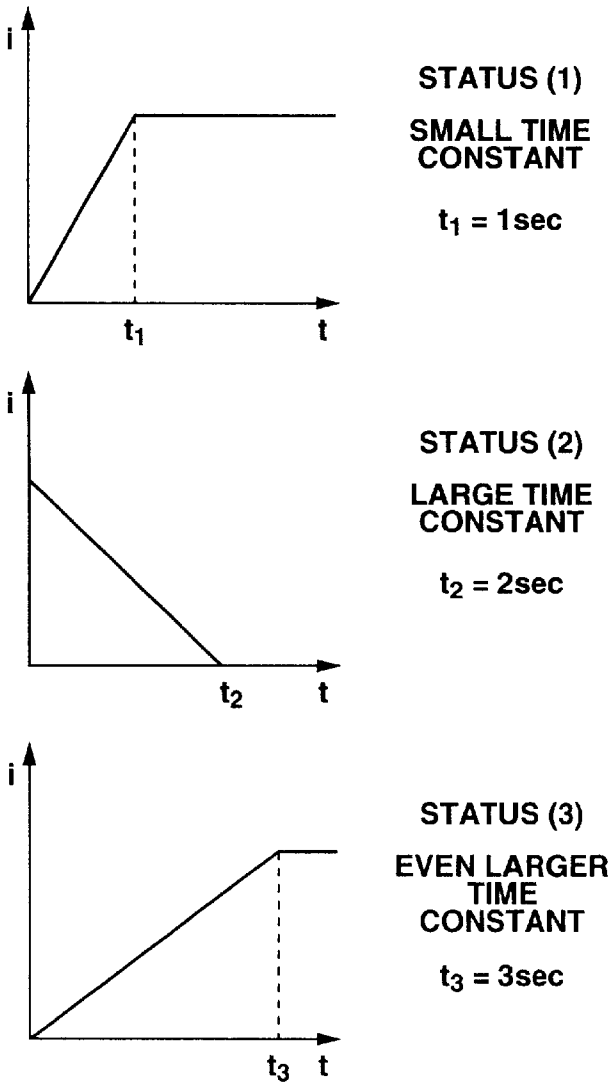
FIG. 9(*a*) shows the EPC valve output processing procedure in FIG. 6, and FIGS. 9(*b*), 9(*c*) and 9(*d*) illustrate the contents of the different modulation processing for each status.
Figure 9A:
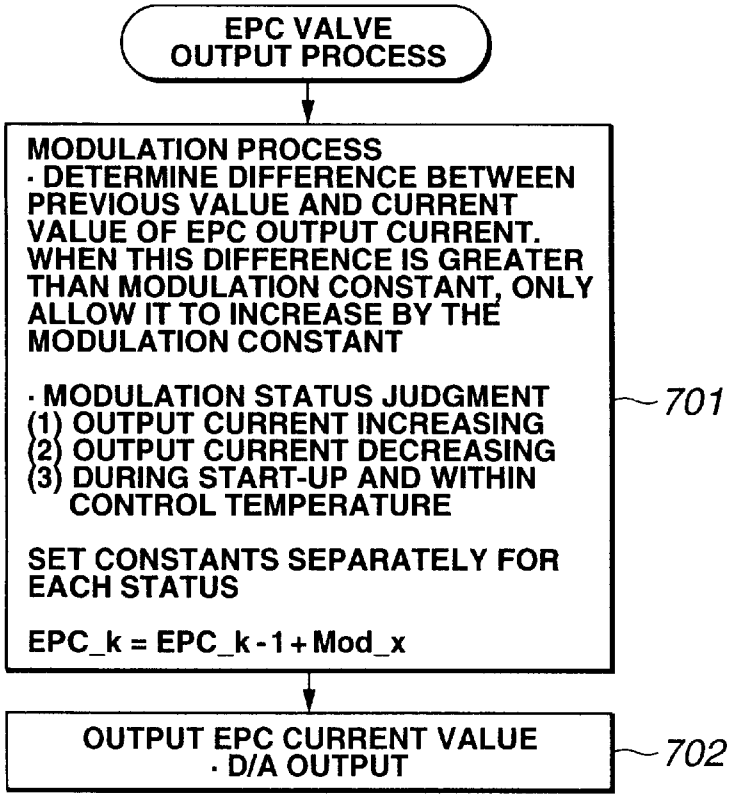

That is, as shown by step 701 in FIG. 9(*a*), a modulation process is performed whereby the current value i to be applied to EPC valve 40 is gradually increased or decreased. The command current i is applied to the EPC valve 40 at each sampling time. Here the command current value i applied to EPC valve 40 at the previous sampling time is denoted by $EPC_{k-1}$. The command current value i that is currently to be applied to EPC valve 40 is denoted by $EPC_k$.

The difference between $EPC_k$ and $EPC_{k-1}$ is determined, and a judgment is made as to whether or not this difference is greater than the modulation constant $Mod_x$.

Here, when the value of the difference between $EPC_k$ and $EPC_{k-1}$ is less than or equal to the modulation constant $Mod_x$, the command current value i obtained from the graph of FIG. 8(*b*) is directly adopted as the current command current value $EPC_k$.

On the other hand, when the value of the difference between $EPC_k$ and $EPC_{k-1}$ is greater than the modulation constant $Mod_x$, the current command current value $EPC_k$ is calculated from formula (7) below.

$$EPC_k=EPC_{k-1}+\mathrm{Mod}_x \tag{7}$$

Here the value of the abovementioned modulation constant $Mod_x$ varies according to the existing status as shown below.

(1) Current output increasing (2) Current output decreasing (3) During engine start-up and when within the control temperature That is, when the current output is increasing in a status (1) when the difference between $EPC_k$ and $EPC_{k-1}$ has a positive polarity and the command current value i is increasing with respect to the EPC valve 40, the modulation constant $Mod_x$ is determined so that the time constant $t_1$ of the increase in current becomes smaller ($t_1$=1 sec) as shown in FIG. 9(*b*). The purpose of this is to prevent problems such as cavitation in the hydraulic pump 2.

Also, in status (2) when the difference between $EPC_k$ and $EPC_{k-1}$ has a negative polarity and the command current value i is decreasing with respect to the EPC valve 40, the modulation constant $Mod_x$ is determined so that the time constant $t_2$ of the decrease in current becomes larger ($t_2$=2 sec) as shown in FIG. 9(*c*). The purpose of this is to prevent problems such as overrunning the hydraulic motor 7.

Also, in status (3) when engine 1 has just been started and the coolant temperature $T_c$ is currently within the control temperature of 80° C., the modulation constant $Mod_x$ is determined so that the time constant $t_3$ of the change in current becomes larger ($t_3$=3 sec) as shown in FIG. 9(*c*). The purpose of this is to prevent problems such as peak pressures occurring inside the hydraulic ducts when the temperature is decreasing (step 702).

Next, the current command current value $EPC_k$ obtained in the above way is converted from a digital signal into an analog signal, and is output as a command current i to the EPC valve 40 (step 702).

The above constitutes the EPC valve output processing (step 104).

As a result, the output pressure of the EPC valve 40 is varied, the swash plate 2*a* of the hydraulic pump 2 is changed accordingly, and the fan rotation speed N of the cooling fan 8 is matched to the target fan rotation speed FAN.

In this way, with the present embodiment, a target fan rotation speed FAN that is necessary and sufficient for cooling is determined from the current detected temperature $T_c$ of the coolant, and the cooling fan 8 rotates at this target fan rotation speed FAN.

Consequently, the coolant is cooled with optimal energy efficiency. Also, the cooling fan 8 produces no more noise than is necessary. That is, since the rotation speed of the cooling fan 8 is varied without stages, it reaches the rotation speed FAN necessary and sufficient for cooling. Consequently the rotation speed does not increase beyond the rotation speed sufficient and necessary for cooling, and energy losses do not occur. Also there is no noise generated by the cooling fan 8. Furthermore, since there is no recirculation to the tank due to a flow rate control valve restricting the flow rate as in the prior art, there are also no energy losses due to an excessive flow rate.

In this way, with the present embodiment, when the cooling fan 8 is driven with the hydraulic motor 7 as a hydraulic source, it can be driven with optimal energy efficiency, and the noise can be controlled to a minimum.

According to another embodiment mode, an oil cooler 60 is provided in addition to a radiator 57 opposite the cooling fan 8 as shown in FIGS. 14 and 15, whereby it is possible to efficiently cool not just the coolant but also the pressure oil of the torque converter 43 or the pressure oil inside the hydraulic cylinder.

Shutters 61 and 62 in FIG. 14 are driven and controlled by the controller 47 so that the coolant and pressure oil are cooled with optimal efficiency.

For example, by appropriately operating the shutter 61 when the pressure oil temperature has become too low, it is possible to introduce the stream of air generated by the cooling fan 8 only towards the heat dissipating surfaces of the radiator 57. Also, by appropriately operating the shutter 62 when the coolant temperature has become too low, it is possible to introduce the stream of air generated by the cooling fan 8 only towards the heat dissipating surfaces of the oil cooler 60.

Also, the airflow adjusting plate 63 in FIG. 15 is driven and controlled by the controller 47 so that the coolant and pressure oil are cooled with optimal efficiency.

For example, by appropriately changing the inclined position of the airflow adjusting plate 63 in the direction of position C, when the pressure oil is in an excessively cool state, the cooling air stream directed toward the excessively cool oil cooler 60 can be reduced. Also, by appropriately changing the inclined position of the airflow adjusting plate 63 to the direction of position D when the coolant is in an excessively cool state, the cooling air stream directed toward the excessively cool radiator 57 can be reduced.

Note that in some cases either the radiator 57 or the oil cooler 60 can be provided opposite the cooling fan 8 so that only the coolant or only the pressure oil is cooled by the fan 8.

Also, with the present embodiment, as shown in formula (2) above ($T=MAX(T_c, T_{tc}-25°)$), the detected coolant temperature $T_c$ or the temperature obtained by subtracting 25° C. from the detected torque converter oil temperature $T_{tc}$—whichever is the larger—is set as the control temperature T, and the target fan rotation speed is determined according to this control temperature T. That is, the target fan rotation speed is determined as the target fan rotation speed corresponding to the detected coolant temperature $T_c$ or the target fan rotation speed corresponding to the temperature $T_{tc}-25°$ C. obtained by subtracting 25° C. from the detected torque converter temperature $T_{tc}$, whichever is the larger. The swash plate 2*a* of the hydraulic pump 2 is then controlled so that the rotation speed of the cooler fan 8 becomes this target fan rotation speed.

In this way, according to the present embodiment mode, a target fan rotation speed FAN that is necessary and sufficient for cooling is determined from the current detected coolant temperature $T_c$ and the pressure oil detected temperature $T_{tc}$ and the cooling fan 8 is rotated at this target fan rotation speed $FAN_{RPM}$.

Consequently, it is possible to cool the coolant and pressure oil with optimal energy efficiency. Furthermore, with the present embodiment mode, as shown by formula (2) above ($T=MAX(T_c, T_{tc}-25°\ C.)$), since the control temperature T is determined as the coolant temperature $T_c$ or the temperature obtained by subtracting 25° C. from the detected torque converter temperature $T_{tc}$—whichever is the larger—cooling is performed in conjunction with the cooling medium of the coolant or the pressure oil, whichever is being insufficiently cooled, and it is possible to avoid situations where the cooling of one of these is insufficient, even when the coolant and pressure oil are both cooled by the cooling fan 8.

Also, in the present embodiment mode, since the current command current value $EPC_k$ is calculated and sequentially output to the EPC valve 40 according to formula (7) above ($EPC_k=EPC_{k-1}+Mod_x$), the actual fan rotation speed of the cooling fan 8 is gradually changed until it reaches the target fan rotation speed FAN. Consequently, sharp fluctuations in the fan rotation speed are prevented, and it is possible to prevent damage to the hydraulic equipment, especially the hydraulic motor 7.

Also, with the present embodiment mode, since the target fan rotation speed FAN is restricted to 70% (1225 rpm) of the maximum rotation speed (1750 rpm) or less when the rotation speed limiting switch 46 is operated, it is possible to suppress noise to within a fixed level when the noise is limited by noise regulations and the like.

Also, with the present embodiment, the target fan rotation speed FAN is set according to the operating mode M selected and notified by the operating mode selector switch 55. Consequently it is possible to rotate the cooling fan 8 at a target rotation speed that matches the operating mode in which the construction machinery is currently operating, and it is possible for it to be operated with optimal energy efficiency for the work being undertaken.

The embodiment mode described above can be varied in a variety of different ways. A variety of different modified examples are described below.

When the present invention is applied to construction machinery, dead leaves, dust and the like can sometimes be sucked into the heat dissipating surfaces (core) of the radiator 57 or oil cooler 60. When dead leaves or the like are sucked in, the cooling efficiency of the radiator 57 and oil cooler 60 decreases. Accordingly, they must be removed.

To achieve this, the following operations are performed. The valve position of a switching valve 65 is switched to the reverse position by an operating lever 66. In this way, the pressure oil inflow direction with respect to the hydraulic motor 7 is switched, and the hydraulic motor 7 is turned in the opposite direction. Consequently the cooling fan 8 is turned in the opposite direction to the direction when cooling the coolant (or pressure oil). As a result the dead leaves, dust and the like that have been sucked into the radiator 57 or oil cooler 60 are discharged.

Also, this switching control can be performed automatically by the controller 47.

The controller 47 performs control to periodically switch the rotation direction of the cooling fan 8 in the following way.

That is, a judgment is made in the controller 47 as to whether or not engine 1 has been started based on the detection signal from engine rotation speed sensor 44. As a result, when it is judged that the engine has been started, a command current is output to the electromagnetic solenoid of the switching valve 65, whereby the valve position of the switching valve 65 is switched to the reverse position. In this way, the pressure oil inflow direction with respect to the hydraulic motor 7 is switched, and the hydraulic motor 7 is turned in the reverse direction. Consequently the cooling fan 8 is turned in the reverse direction to when cooling of coolant (or pressure oil) is performed. The target fan rotation speed of the cooling fan 8 at this time can be set to the maximum rotation speed. As a result, the dead leaves, dust and the like that have been sucked into the radiator 57 or oil cooler 60 are periodically discharged by a maximum-strength stream of air every time the engine 1 is started.

A timer may also be incorporated into controller 47, and the rotation of the cooling fan 8 may thereby by reversed at periodic intervals (e.g. every 30 minutes) while the engine 1 is in operation. In working environments where dead leaves and the like are present in large quantities, it is desirable to discharge the dead leaves and the like that have been sucked into the heat dissipating surfaces at periodic intervals.

Also, when a hydraulic circuit equipped with a pump capable of two-directional flow is employed, the swash plate of the hydraulic pump 2*b* is controlled by the controller 47, whereby the pressure oil discharge outlet is switched so that the inlet and outlet during cooling are switched over. In this way the pressure oil inflow direction with respect to the hydraulic motor 7 is switched over. Consequently, the rotation direction of the cooling fan 8 is switched from the direction A1 in which it rotates during cooling to the opposite direction A2, and the dead leaves, dust and the like are discharged from the radiator 57 or oil cooler 60.

In this way, since the dead leaves, dust and the like that have been sucked into the radiator 57 or oil cooler 60 are periodically discharged, it is possible to keep the interior of the engine room clean even when working in environments where there are large amounts of dead leaves, dust and the like. It is also possible to prevent reduction of the cooling efficiency of the radiator 57 or oil cooler 60 due to blockages caused by dead leaves, dust and the like.

Incidentally, in the embodiment mode described above, if the detected coolant temperature $T_c$ indicates a high value while the engine is operating, there is a danger that the following problem may arise. That is, the command current i is output from the controller 47 to the EPC valve 40, and the pressure oil at a high pressure corresponding to this high temperature is made to flow into the hydraulic duct 42. When this happens, the pressure inside the duct 42—which is zero before the engine is started—reaches a peak just after the engine is started, and there is a danger that an excessive load may be placed on the duct 42.

Therefore, the following control can be performed by the controller 47 when the engine is started up, regardless of how large the detected coolant temperature $T_c$ is.

That is, a judgment is made as to whether or not the engine 1 has been started up based on the detected signal of the engine rotation speed sensor 44. As a result, when it is judged that the engine has been started up, a command current i is output to an electromagnetic solenoid 40*a* of the EPC valve 40 in order to minimize the tilt angle of the swash plate 2*a* of the hydraulic pump 2 (to minimize the capacity).

In this way, low pressure pressure oil is made to flow into the hydraulic duct 42 when the engine 1 is started up, so no peak pressure occurs inside the duct 42. Consequently, when the engine 1 is started up, even if the detected coolant temperature $T_c$ already exhibits a high value, no peak pressure is applied to the duct 42, and damage to the hydraulic equipment is prevented. Also, since the capacity of the pump 2 is at its minimum, the absorption torque of the pump 2 is at its maximum. Accordingly, since the load in engine 1 is reduced, the starting properties of the engine 1 are improved.

Figure 12:
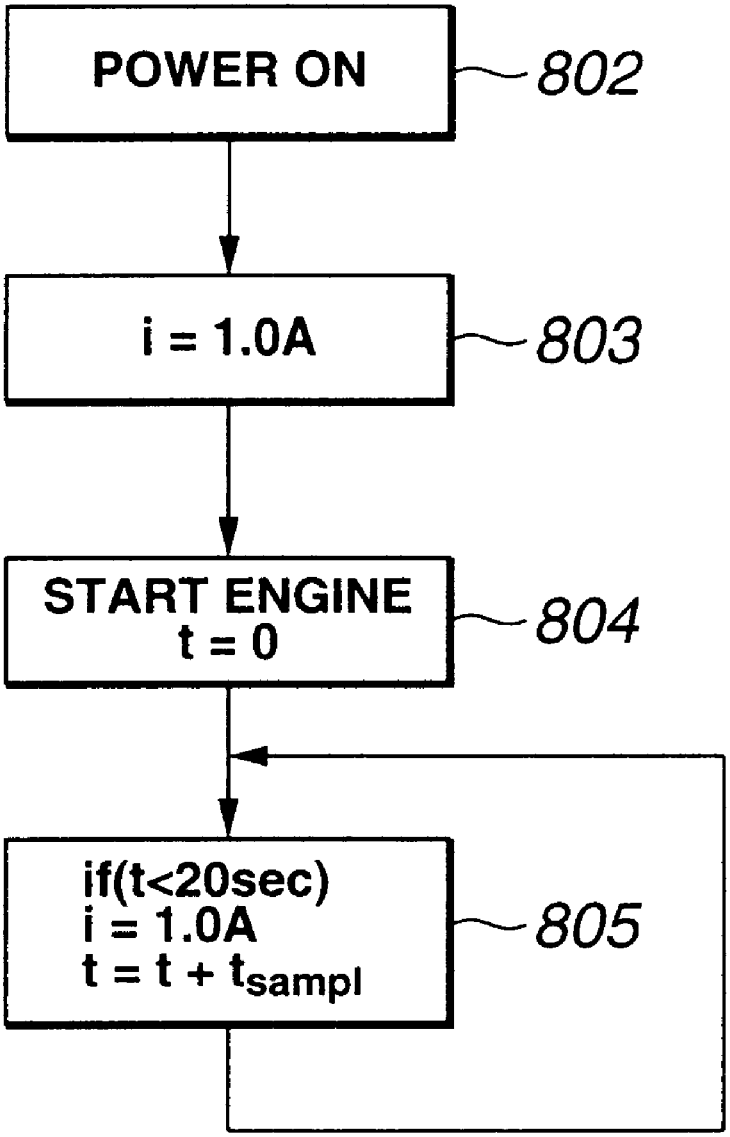
FIG. 12 shows the control processing procedure directly after the engine is started up.

The abovementioned control may also be performed for a fixed period after the engine 1 is started up. FIG. 12 shows the processing procedure for a fixed period (20 sec) after the engine 1 is started up.

That is, when the electrical power source is turned on (step 802), the contents of i is taken to be 1.0 A (step 803), and when it is detected that the engine 1 has been started up, the clock time t of a software clock timer is reset to zero (step 804).

Then every time the sampling time $t_{sampl}$ has elapsed, the contents of the clock time t of the abovementioned software time is updated to the following:

$$t=t+t_{sampl}$$

As long as the content of t is 20 sec or less, the content of i is kept at 1.0 A. This 1.0 A command current i is output to the EPC valve 40. Consequently, for a 20-second period after starting up the engine, the tilt angle of the swash plate 2*a* of the hydraulic pump 2 is forcibly kept to a minimum (to the minimum capacity) (step 805).

Note that when hydraulic motor 7 is a variable-capacity type, the abovementioned control may be performed so as to minimize the capacity of the hydraulic motor 7 instead of the hydraulic pump 2.

Incidentally, parts with relatively low heat resistance, such as harnesses and hoses, may be provided inside the engine room in which the cooling fan 8 is contained.

Therefore, the lifetime of the abovementioned components with relatively low heat resistance, such as harnesses and hoses, may be extended by periodically removing the hot gas inside the engine room under the control of the controller 47.

That is, the controller 47 is provided with a timer. In the controller 47, a judgment is made as to whether or not a fixed time (e.g. 10 minutes) has elapsed since the timer was reset. When it is judged by the timer that a fixed time has elapsed, the maximum rotation speed is forcibly set as the target fan rotation speed FAN regardless of what the current target fan rotation speed of the cooling fan 8 is. A command current i for which the maximum rotation speed is obtained is then output to the EPC valve 40 for a short time. Consequently, the cooling fan 8 is rotated at maximum speed for a short time. After the short period of time for which it is rotated at maximum speed has elapsed, the timer is reset and the processing described above is performed repeatedly.

In this way, even if the engine 1 has been running at the idling rotation speed and the detected coolant temperature $T_c$ has been at a low temperature state, the rotation speed of the cooling fan 8 is forcibly increased to the maximum rotation speed. It is thereby possible to periodically exhaust the hot gas inside the engine room in which the cooling fan 8 is contained, and to increase the lifetime of components that have low heat resistance such as harnesses and hoses. Note that is it not absolutely necessary for the increased rotation speed of the cooling fan 8 to be the maximum rotation speed, and a high rotation speed close to the maximum rotation speed is sufficient.

In the above embodiment mode, a target fan rotation speed $FAN_{RPM}$ is associated with each control temperature (T sensed coolant temperature $T_c$, pressure oil temperature $T_{tc}$) as shown in FIG. 2. An embodiment in which such a correspondence is unnecessary is described below.

Figure 11:
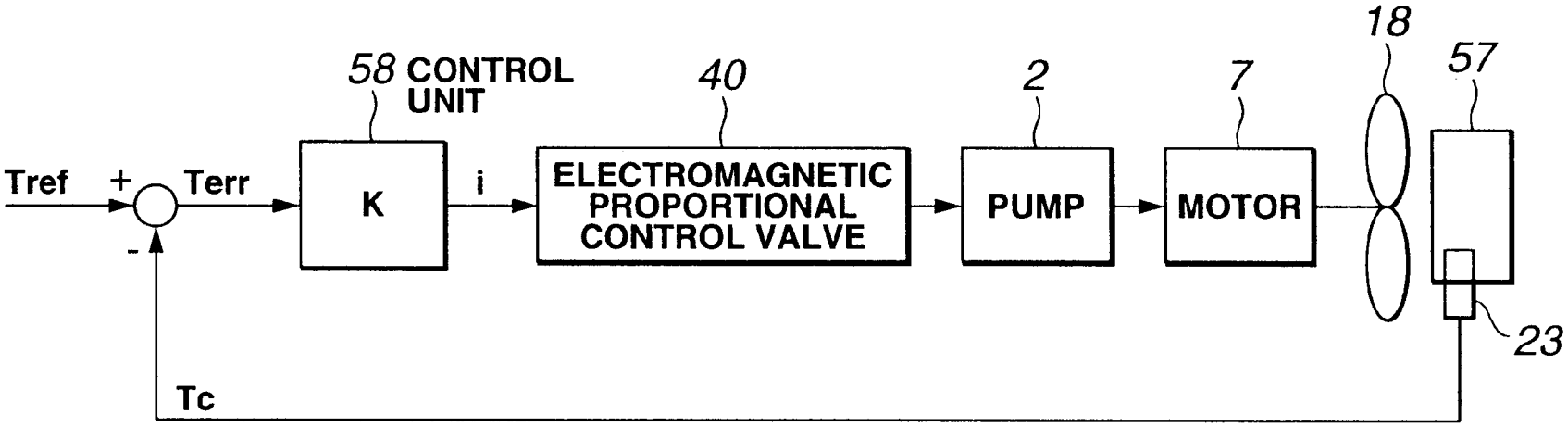
FIG. 11 is a control block diagram of an embodiment mode.

FIG. 11 shows a control block diagram of this embodiment mode. A control unit 58 in FIG. 11 corresponds to the controller 47 in FIGS. 1(*a*) and 1(*b*).

In this embodiment mode, the temperature at which the efficiency of engine 1 is optimized is set as the coolant target temperature $T_{ref}$. The difference $T_{err}$ between this target temperature $T_{ref}$ and the actual sensed coolant temperature $T_c$ sensed by the temperature sensor 23 is then calculated and applied to the control unit 58.

In the control unit 58, the value of the command current i is determined according to formula (8) below.

$$i=io+T_{err}\cdot\text{Gain} \tag{8}$$

In the above formula 8, the fixed current value io and the gain Gain are known values.

The command current value i obtained from the above formula (8) is output to the EPC valve (electromagnetic proportional control valve) 40.

As a result, the actual temperature $T_c$ of the coolant is accurately matched to the target temperature $T_{ref}$, thereby maximizing the efficiency of the engine 1. Also, with the embodiment shown in FIG. 11, since there is no need to establish a target fan rotation speed $FAN_{RRM}$ for each coolant temperature $T_c$ as shown in FIG. 3, it is possible to simplify the work associated with setting computational formulae and memory tables.

Note that in the control block diagram shown in FIG. 11, a target temperature can be set for the pressure oil (the pressure oil of the torque converter 43 or the hydraulic cylinder) instead of a target temperature for the coolant. In this case the configuration can be such that a temperature sensor is used to sense the oil temperature of the pressure oil (the pressure oil of the torque converter 43 or the hydraulic cylinder) instead of the temperature sensor 23 which senses the coolant temperature, allowing the actual temperature of the pressure oil to be matched to the target temperature. In this way it is possible to operate the torque converter 43 or the hydraulic cylinder with optimal efficiency.

An embodiment mode in which the coolant temperature can be matched to the optimal value and the noise produced by the cooling fan 8 can be simultaneously reduced is described below with reference to the same control block diagram shown in FIG. 11.

In this embodiment mode, the coolant target temperature $T_{ref}$ is set to the temperature at which the efficiency of the engine 1 is optimized, e.g. 90° C. It is also assumed that the permissible rotation speed $F_{min}$ of the cooling fan 8 is set to 1200 rpm. When the cooling fan 8 is rotated at this permissible rotation speed of 1200 rpm, the noise level is 85 dB. The difference $T_{err}$ between the abovementioned target temperature $T_{ref}$ and the actual detected coolant temperature $T_c$ sensed by the temperature sensor 23 is then calculated and applied to the control unit 58. Note that the value of the permissible rotation speed $F_{min}$ is only given as an example, and the present invention is not limited thereto.

In the control unit 58, the command current value i is output according to the procedure (a) through (f) below.

(a) In the initial state, the command current value i is set to 1.0 A.

(b) Formula (9) below is used to determine the current target fan rotation speed FAN from the current command current value i.

$$FAN=f(i) \tag{9}$$

The above relationship formulaf can be obtained from the correspondence relationship between the target fan rotation speed FAN and the pump target flow rate $Q_{ccrev}$ shown in formula (5) above ($Q_{ccrev}=FAN\cdot M_{ccrev}/ENG_{RPM}$) and from the correspondence relationship between the target flow rate $Q_{ccrev}$ and the command current value i shown in FIG. 8(*b*).

(c) A judgment is made as to whether or not the target fan rotation speed FAN resulting from the calculation of formula (9) above is less than or equal to the permissible rotation speed $F_{min}$ (1200 rpm).

(d) If the target fan rotation speed FAN is less than or equal to the permissible rotation speed $F_{min}$ (1200 rpm), the command current value i is calculated according to the abovementioned formula 8 shown below, and is output to the EPC valve 40.

$$i=i_0+T_{err}\cdot G_{ain} \ldots 8$$

e If the target fan rotation speed FAN is greater than the permissible rotation speed $F_{min}$ 1200 rpm, the command current value i is calculated according to formula 10 below, and is output to the EPC valve 40.

$$i=i_0+T_{err}\cdot G_{ain}-(FAN-F_{min})\cdot G_{fan} \tag{10}$$

The abovementioned gain $G_{fan}$ is a gain for noise reduction which is set in order to bring the rotation speed of the cooling fan 8 within the permissible rotation speed $F_{min}$. On the other hand, the gain $G_{ain}$ is a gain for temperature control which is set in order to match the coolant temperature to the target temperature $T_{ref}$. When greater importance is attached to the control of noise reduction, the noise reduction gain $G_{fan}$ is set to a larger value than the temperature control gain $G_{ain}$. When greater importance is attached to the control of temperature, the noise reduction gain $G_{fan}$ is set to a smaller value than the temperature control gain $G_{ain}$. That is, the way in which $G_{fan}$ and $G_{ain}$ are set determines the weighting applied to the noise reduction control and temperature control.

(f) The same process is repeated from step (b) above.

Thus with the present embodiment mode, as shown in (d) above, as long as the rotation speed of the cooling fan 8 is within the permissible limit $F_{min}$, temperature control is performed whereby the actual temperature $T_c$ of the coolant is matched to the target temperature $T_{ref}$ according to formula (8) with the noise kept within the permissible level (85 dB). Also, as shown in e above, when the rotation speed of the cooling fan 8 has become greater than the permissible speed $F_{min}$, the noise is greater than the permissible level (85 dB), and thus according to formula (10), the noise is reduced by applying prescribed weightings whereby temperature control is performed to match the actual temperature $T_c$ of the coolant to the target temperature $T_{ref}$, and noise reduction control is performed to bring the actual rotation speed of the cooling fan 8 within the permissible rotation speed $F_{min}$. Consequently with the present embodiment, it is possible to match the coolant temperature to an optimal value while simultaneously reducing the noise produced by the cooling fan 8.

The abovementioned temperature control is only given as an example, and the control can be performed by the following procedure (g) through (k).

(g) A rotation speed FAN1 (1200 rpm) is set corresponding to the target temperature $T_{ref}$ (90° C.). The noise level produced when the cooling fan 8 rotates at this rotation speed FAN1 (1200 rpm) is 85 dB, which is within the permissible level. A permissible coolant temperature $T_u$ (93° C.) that can be tolerated in terms of the efficiency of the engine 1 is also set. A rotation speed FAN2 (1300 rpm) is set corresponding to this permissible coolant temperature $T_u$ (93° C.). The noise level produced when the cooling fan 8 rotates at this rotation speed FAN2 (1300 rpm) is 90 dB.

(h) A judgment is made as to whether or not the actual temperature $T_c$ of the coolant as sensed by temperature sensor 23 is less than or equal to the abovementioned permissible coolant temperature $T_u$.

(i) When the actual coolant temperature $T_c$ is less than or equal to the abovementioned permissible coolant temperature $T_u$, the target flow rate $Q_{ccrev}$ is calculated with the target fan rotation speed FAN in formula (5) above ($Q_{ccrev}$=FAN·$M_{ccrev}$/$ENG_{RPM}$) set to the rotation speed FAN1 (1200 rpm). The command current i is then determined from this calculated target flow rate $Q_{ccrev}$ and from the correspondence relationship shown in FIG. 8(*b*). This command current i is output to the EPC valve 40.

(j) When the actual temperature $T_c$ of the coolant exceeds the abovementioned permissible coolant temperature $T_u$, the target flow rate $Q_{ccrev}$ is calculated with the target fan rotation speed FAN in formula (5) above ($Q_{ccrev}$=FAN·$M_{ccrev}$/$ENG_{RPM}$) set to the rotation speed FAN2 (1300 rpm). The command current i is then determined from this calculated target flow rate $Q_{ccrev}$ and from the correspondence relationship shown in FIG. 8(*b*). This command current i is output to EPC valve 40. In this way the actual coolant temperature can be brought within the permissible coolant temperature $T^u$.

(k) The same process is repeated from step (h) above.

Thus with the present embodiment mode, as shown in (i) and (j) above, the noise is suppressed to the permissible level (85 dB) as long as the actual temperature $T_c$ of the coolant is within the permissible coolant temperature $T_u$, and only when the actual temperature $T_c$ of the coolant exceeds the permissible coolant temperature $T_u$, is the rotation speed of the cooling fan 8 increased to bring the actual temperature of the coolant within the permissible coolant temperature $T_u$.

Therefore the present embodiment mode is also capable of reducing the noise produced by the cooling fan 8 while controlling the coolant temperature to an optimal value.

Control can also be performed by the following procedure (l) through (q).

(l) A target rotation speed FAN1 (1200 rpm) is set corresponding to the target temperature $T_{ref}$(90° C.). The noise level produced when the cooling fan 8 is rotated at this rotation speed FAN1 (1200 rpm) is 85 dB, which is within the permissible level. An upper threshold value (93° C.) is also set for the coolant temperature. A lower threshold value (80° C.) is also set for the coolant temperature.

(m) A judgment is made as to whether the actual coolant temperature $T_c$ sensed by the temperature sensor 23 exceeds the upper threshold value or is lower than the lower threshold value.

(n) When the actual temperature $T_c$ of the coolant lies between the upper threshold value and the lower threshold value, the target flow rate $Q_{ccrev}$ is calculated with the target fan rotation speed FAN in formula (5) above ($Q_{ccrev}$=FAN·$M_{ccrev}$/$ENG_{RPM}$) set to the target rotation speed FAN1 (1200 rpm). The command current i is then determined from this calculate target flow rate $Q_{ccrev}$ and from the correspondence relationship shown in FIG. 8(*b*). This command current i is output to the EPC valve 40.

(o) When the actual temperature $T_c$ of the coolant exceeds the abovementioned upper threshold value, the target flow rate $Q_{ccrev}$ is calculated with the target fan rotation speed FAN in formula (5) above ($Q_{ccrev}$=FAN·$M_{ccrev}$/$ENG_{RPM}$) set to the maximum rotation speed (1750 rpm). The command current i is then determined from this calculated target flow rate $Q_{ccrev}$ and from the correspondence relationship shown in FIG. 8(*b*). This command current i is output to the EPC valve 40.

(p) When the actual temperature $T_c$ of the coolant is less than the abovementioned lower threshold value, the target flow rate $Q_{ccrev}$ is calculated with the target fan rotation speed FAN in formula (5) above ($Q_{ccrev}$=FAN·$M_{ccrev}$/$ENG_{RPM}$) set to the minimum rotation speed (647 rpm). The command current i is then determined from this calculated target flow rate $Q_{ccrev}$ and from the correspondence relationship shown in FIG. 8(*b*).

(q) The same process is repeated from step (m) above.

The above embodiment mode, which combines temperature control with noise reduction control, can be applied not only to controlling the coolant temperature but also to controlling the temperature of the pressure oil (the pressure oil of the torque converter 43 or the hydraulic cylinder).

The abovementioned embodiment was described assuming the case where either the hydraulic pump 2 or the hydraulic motor 7 has a variable capacity, while the other has a fixed capacity. Next, an embodiment is described with reference to FIG. 10 in which the hydraulic pump 2 and the hydraulic motor 7 both have variable capacity.

The hydraulic circuit shown in FIG. 10 is mounted in construction machinery such as a hydraulic shovel, for example. When applied to construction machinery, the variable capacity hydraulic pump 2 shown in this FIG. 10 is the hydraulic supply source that supplies pressure oil to a hydraulic cylinder 4 that operates a boom, for example.

The hydraulic pump 2 is driven with the engine 1 as its drive source. The hydraulic pump 2 is configured from a swash plate type piston pump, for example. Changes in the swash plate 2*a* of hydraulic pump 2 cause changes in the displacement (capacity) (cc/rev) of the hydraulic pump 2.

The displacement (capacity) of the hydraulic pump 2 is changed by driving a swash plate drive mechanism unit 5.

The hydraulic pump 2 draws in pressure oil from inside a tank 9 and discharges pressure oil at an discharge pressure P from a pressure oil discharge outlet 2*b*. The pressure oil discharged from the hydraulic pump 2 is supplied to an operating valve 3 via a duct 11.

The aperture area of the operating valve 3 is changed according to the operating quantity of the operating lever 14, thereby controlling the flow rate of pressure oil discharged from hydraulic pump 2. The pressure oil discharged from the hydraulic pump 2 is supplied to the hydraulic cylinder 4 via the operating valve 3. By supplying pressure oil to the hydraulic cylinder 4, the hydraulic cylinder 4 is driven. By driving the hydraulic cylinder 4, a working mechanism (boom) (not illustrated) is operated.

The configuration of a swash plate drive mechanism part 5 is described next.

The swash plate drive mechanism part 5 is connected to an LS pressure duct 16 which is branched off from a duct 12, and to a duct 22 which is branched off from the duct 11.

The swash plate drive mechanism part 5 is provided with a servo piston 21 which changes the pump capacity by driving the swash plate 2*a* of the hydraulic pump 2 according to the flow rate of the pressure oil flowing into it. It also comprises an LS valve 20 which causes a signal pressure $P_{LS}$—which depends on the discharge pressure P of the hydraulic pump 2 which is applied to a pilot port 20, and on the load pressure of the hydraulic cylinder 4—to flow into a servo piston 21.

The LS valve 20 controls the pressure difference $\Delta P=(P-P_{LS})$ between the discharge pressure of the hydraulic pump 2 and the signal pressure $P_{LS}$ corresponding to the load pressure of the hydraulic cylinder 4 so as to maintain a first set pressure difference $\Delta P_{LS}$. This control is called load sensing control. The first set pressure difference $P_{LS}$ is determined according to the spring force of a spring 20*a* which urges the LS valve 20, and the pressurized surface area of pilot ports 20*b* and 20*c* of the LS valve 20.

That is, pump discharge pressure P is applied to the pilot port 20*b* of the LS valve 20 via a duct 22. On the other hand, a signal pressure corresponding to the load pressure $P_{LS}$ is applied via a LS pressure duct 16 to a pilot port 20*c* which is provided on the same side as the spring 20*a* so as to face toward the abovementioned pilot port 20*b*.

Accordingly, when the pressure difference $P-P_{LS}$ is greater then the set pressure difference $\Delta P_{LS}$, the LS valve 20 is moved to the valve position on the left in the figure. This causes the pressure oil discharged from the pump to flow from the LS valve 20 to the servo piston 21. The swash plate 2*a* of the hydraulic pump 2 is thereby moved toward the minimum capacity MIN side. Consequently, the flow rate discharged from the hydraulic pump 2 is decreased and the discharge pressure P of the hydraulic pump 2 becomes smaller. As a result, the pressure difference $P-P_{LS}$ becomes smaller and is matched to the first set pressure difference $\Delta P_{LS}$. Conversely, when the pressure difference $P-P_{LS}$ is less then the set pressure difference $\Delta P_{LS}$, the LS valve 20 is moved to the valve position on the right. This causes the pressure oil to flow from the servo piston 21 to the tank 9 via the LS valve 20, whereby the swash plate 2*a* of the hydraulic pump 2 is moved toward the maximum capacity MAX side. Consequently, the flow rate discharged from the hydraulic pump 2 is increased and the discharge pressure P of the hydraulic pump 2 becomes larger. As a result, the pressure difference $P-P_{LS}$ becomes larger and is matched to the first set pressure difference $\Delta P_{LS}$. In this way, the pressure difference $P-P_{LS}$ is constantly kept at the first set pressure difference $\Delta P_{LS}$ by he LS valve 20.

In the present embodiment mode, the abovementioned hydraulic pump 2, which is provided to drive the working equipment, is used as the hydraulic drive source for the cooling fan 8, whereby the cooling fan 8 is driven. In the hydraulic circuit of FIG. 10, the parts enclosed by the broken line with two dots constitute a cooling fan drive unit 10. This cooling fan drive unit 10 can be constructed as a single entity (motor assembly).

The pump discharge pressure duct 11 of the hydraulic pump 2 is connected to a branched duct 17, and this branched duct 17 is connected to the abovementioned cooling fan drive unit 10.

Also, an LS pressure duct 16 which senses a signal pressure corresponding to the load pressure of the hydraulic cylinder 4 is connected to a branched duct 18, and this branched duct 18 is connected to the abovementioned cooling fan drive unit 10.

The abovementioned duct 17 connects with an inflow port 7*a* of a fan drive hydraulic motor 7. The cooling fan 8 is attached to the output shaft of the fan drive hydraulic motor 7. Consequently, the pressure oil discharged from the hydraulic pump 2 is supplied via ducts 11 and 17 to the fan drive hydraulic motor 7, and the cooling fan 8 is thereby made to rotate. The fan drive hydraulic motor 7 is a variable capacity type hydraulic motor.

The capacity D (cc/rev) of the fan drive hydraulic motor 7 is varied by operating a swash plate drive mechanism unit 6.

The fan drive hydraulic motor 7 allows the pressure oil discharged from the hydraulic pump 2 to flow in from the intake port 7*a*, causing the output shaft to rotate at an output rotation speed N and causing the cooling fan 8 to rotate. The pressure oil that has flowed out from an outflow port 7*b* of the fan drive hydraulic motor 7 is then returned to the tank 9 by way of a duct 27. The drive pressure of the fan drive hydraulic motor 7 constitutes the discharge pressure P of the hydraulic pump 2. The output rotation speed of fan drive hydraulic motor 7, i.e. the rotation speed N of the cooling fan 8, is sensed by a fan rotation speed sensor 36.

Here, the relationship of formula (11) below holds between the absorption torque $T_r$ of the fan drive hydraulic motor 7 and the rotation speed N of cooling fan 8, where $k_1$ is a constant determined by the cooling fan 8. Note that the notation ^2 indicates raising to the power 2 (the same applies in the following).

$$T_r=k_1 \cdot N\ 2 \tag{11}$$

Also, the relationship of formula (12) below holds between the capacity D per rotation of the fan drive hydraulic motor 7, the drive pressure P (kg/cm$^2$) and the rotation speed N of the cooling fan 8, where $k_2$ is a constant.

$$P \cdot D \cdot k_2=k_1 \cdot N\ 2 \tag{12}$$

Also, the relationship of formula (13) below holds between the capacity D per rotation of the fan drive hydraulic motor 7 and the flow rate of the pressure oil supplied to the fan drive hydraulic motor 7 $Q_m$ (1/min), where $k_3$ is a constant.

$$Q_m=N \cdot D \tag{13}$$

Accordingly, as can be clearly seen from formulae (11), (12) and (13) above, the rotation speed N of the cooling fan 8 becomes larger as the drive pressure P and flow rate $Q_m$ of the fan drive hydraulic motor 7 increase. The absorption torque $T_r$ of fan drive hydraulic motor 7 also gets larger as the rotation speed N of the cooling fan 8 increases.

Figure 16:
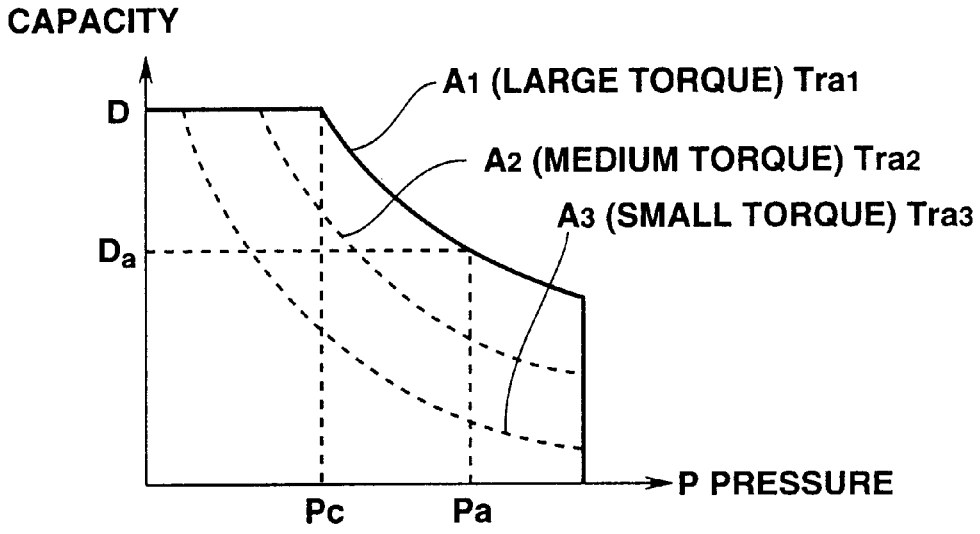
FIG. 16 shows the relationship between the pressure and capacity of the hydraulic motor for driving the fan.

FIG. 16 shows the relationship between the drive pressure P, capacity D and absorption torque $T_r$ of the fan drive hydraulic motor 7. In FIG. 16, curve $A_1$ shows the relationship between the drive pressure P and capacity D obtained with an absorption torque $T_{ra1}$ set to a large value. In curve $A_1$, the value of the set absorption torque $T_{ra1}$ is constant. Curve $A_2$ shows the relationship between the drive pressure P and capacity D obtained with an absorption torque $T_{ra2}$ set to an intermediate magnitude. In curve $A_2$, the value of the set absorption torque $T_{ra2}$ is constant. Curve $A_3$ shows the relationship between the drive pressure P and capacity D obtained with an absorption torque $T_{ra3}$ set to a small value. In curve $A_3$, the value of the set absorption torque $T_{ra3}$ is constant. Here, the set absorption torque $T_{ra1}$ is taken to be the maximum torque value. Note that the absorption torque is constant in each of the curves in FIG. 16.

The temperature $T_t$ of the pressure oil inside tank 9 is sensed by a temperature sensor 45*a*.

A signal indicating the temperature $T_t$ sensed by the abovementioned temperature sensor 45*a* and a signal indicating the fan rotation speed N sensed by the abovementioned fan rotation speed sensor 36 are input to a controller 13, which generates a command current i to vary the set absorption torque value $T_{ra}$. This command current i is output to the cooling fan drive unit 10.

The electromagnetic proportional control valve 24 of the cooling fan drive unit 10 changes its valve position when the command current i output from the controller 13 is input to an electromagnetic solenoid 24*a*. This valve applies a pilot pressure $P_p$—whose magnitude corresponds to the command current i—to the pilot port 25*c* of a TC valve 25, which is described below.

A swash plate drive mechanism unit 6 is configured around a servo piston 26, which drives a swash plate 7*c* of the fan drive hydraulic motor 7 according to the flow rate of the pressure oil flowing into it and thereby changes the capacity D, and a TC valve 25 (torque control valve) 25, which controls the flow rate of pressure oil according to the discharged pressure P of hydraulic pump 2 (the drive pressure P of the fan drive hydraulic motor 7) and the pilot pressure $P_p$ output from an electromagnetic proportional control valve 24, and allows the controlled pressure oil to flow into the servo piston 26.

The TC valve 25 is a valve that performs control to keep the product of the drive pressure P and capacity D—i.e. the absorption torque $T_r$—of the fan drive hydraulic motor 7 at the set absorption torque value $T_{ra}$. That is, the pump discharge pressure P is applied to a pilot port 25*b* of the TC valve 25 via ducts 17, 29 and 29*a*. The pilot pressure $P_p$ is also applied via the electromagnetic proportional control valve 24 to a pilot port 25*c* provided on the same side as the abovementioned pilot port 25*b*. A spring 25*a* is fitted to the TC valve 25 so as to face toward the pilot ports 25*b* and 25*c*. The set absorption torque value $T_{ra}$ is determined according to the pressurized area and the spring force of the spring 25*a* which urges the TC valve 25. It is assumed that the maximum absorption torque value $T_{ra1}$ is set by the spring 25*a*. Also, the set absorption torque value $T_{ra}$ is varied according to the pilot pressure $P_p$ applied to the pilot port 25*c* of the TC valve 25.

The servo piston 26 and TC valve 25 are connected by a duct 35. The pressure oil inside the duct 35 is pressure oil that has flowed out from the outflow port 7*b* of hydraulic motor 7. Pressure oil flows into and out of the servo piston 26 from the TC valve 25 via this duct 35.

The duct 17 is connected to the inlet port of the TC valve 25 via ducts 29 and 32. Pressure oil discharged from the hydraulic pump 2 flows into the inlet port of the TC valve 25 via the ducts 17, 29 and 32.

A duct 18 is connected to a duct 33 via a check valve 19. The duct 33 is connected to the TC valve 25. A fixed choke 34 is fitted in the duct 33. The check valve 19 is a valve that only allows pressure oil that has passed through the TC valve 25 and fixed choke 34 to flow out toward the duct 18. The outflow side of the check valve 19—i.e. the pressure on the side of duct 18—is a signal pressure corresponding to the load pressure $P_{LS}$. On the other hand, the pressure at the inflow side of the check valve 19—i.e. the pressure on the side of duct 33—is referred to as $P_{mLS}$.

The tank 9 is connected via a duct 28, duct 31 and the duct 17 with the inflow port 7*a* of the fan drive hydraulic motor 7. A check valve 30 which only allows the pressure oil inside tank 9 to pass through toward the inflow port 7*a* of the fan drive hydraulic motor 7 is provided in the duct 28.

Next, the operations performed by the hydraulic circuit of FIG. 10 are described, centered on the processing performed by controller 13 shown in FIG. 10.

Torque Control

The controller 13 performs constant-torque control whereby the absorption torque $T_r$ of the fan drive hydraulic motor 7 becomes a constant absorption torque $T_{ra}$. The reason for performing constant-torque control is as follows.

In the prior art, the fan drive hydraulic motor is driven by an hydraulic pump for exclusive fan drive use which is provided separately from the hydraulic pump used to drive the working equipment. Consequently, the absorption torque of the fan drive hydraulic motor is unaffected by fluctuations in the load on the working equipment or the operating valve aperture area. The absorption torque of the fan drive hydraulic motor is thus relatively stable and is kept at a constant value. Fluctuations in the fan rotation speed of the cooling fan are thus suppressed, and its rotation can be stabilized.

But in the embodiment mode shown in FIG. 10, the hydraulic pump 2 that drives the working equipment also acts as a hydraulic pump for driving the fan by driving the fan drive hydraulic motor 7. Consequently, it is affected by fluctuations in the load on the working equipment and fluctuations in the aperture area of the operating valve 3, and the absorption torque of the fan drive hydraulic motor 7 is not stable. Accordingly, the fan rotation speed of the cooling fan 8 fluctuates, and its rotation speed does not stabilize.

Therefore, control is performed to keep the absorption torque $T_r$ of the fan drive hydraulic motor 7 at a constant value $T_{ra}$ in order to suppress fluctuations in the fan rotation speed of the cooling fan 8 and stabilize its rotation.

The target fan rotation speed $N_a$ required for the cooling fan 8 is stored in controller 13. A target fan rotation speed $N_a$ has correspondence with each temperature $T_t$ of tank 9. When the cooling fan 8 is rotated at the target fan rotation speed $N_a$, the pressure oil is cooled optimally. The correspondence relationship between these temperatures $T_t$ and target fan rotation speeds $N_a$ can be determined by simulations, experiments and the like.

Note that in the embodiment mode shown in FIG. 10 it is assumed that the cooling fan 8 is used to cool the pressure oil used to operate the hydraulic cylinder 4 and the like, but it goes without saying that it can also be applied to cases where it cools not only the pressure oil but also the engine 1 (coolant). In this case it is possible to adopt the positional configuration of the radiator 57 and oil cooler 60 described above and shown in FIGS. 14 and 15.

In this case, the engine 1 is cooled by a coolant circulating through a water jacket. The coolant, whose temperature has increased as a result of the cooling engine 1, is supplied to the radiator 57 where it is cooled by the stream of air produced by the abovementioned the cooling fan 8. It is then returned to the water jacket in the engine 1. When the engine 1 is an air-cooled engine, the engine 1 may be directly cooled by the stream of air produced by the cooling fan 8.

The present invention can also be applied to cases where the cooling fan 8 is only used to cool the engine 1 and does not cool the pressure oil.

When the cooling fan 8 is used to cool both the engine 1 and the pressure oil, besides sensing the temperature $T_t$ of the tank 9, the coolant temperature (water temperature) $T_c$ is sensed by a temperature sensor 23 (see FIG. 1) identical to the temperature sensor 45*a*.

Figure 17:
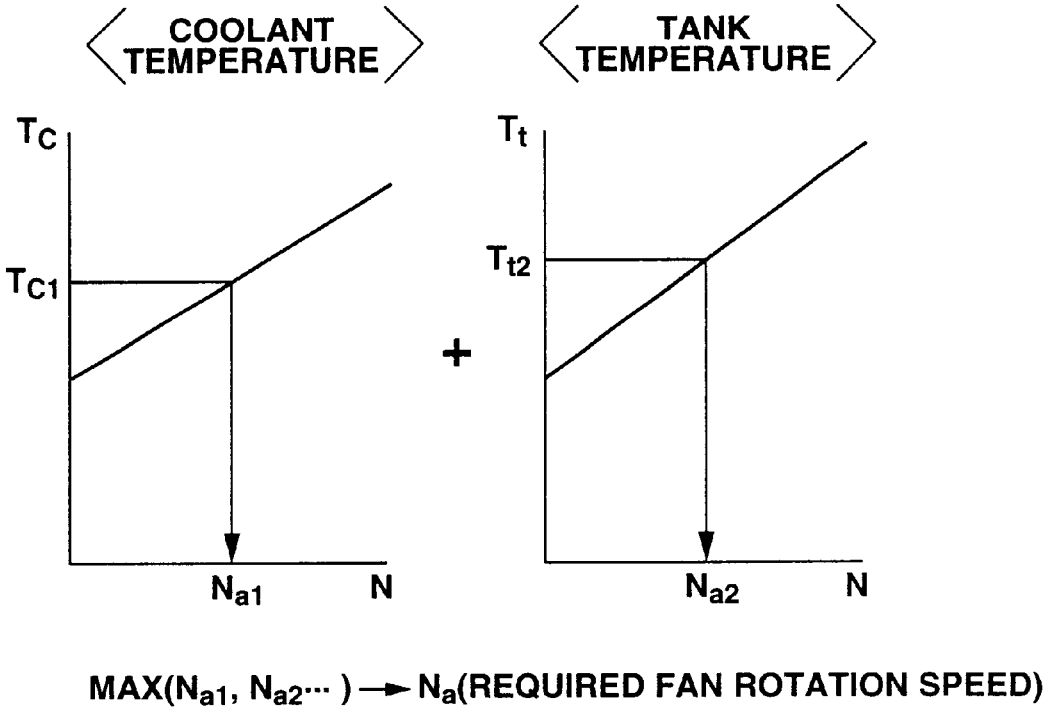
FIG. 17 describes the relationship between the temperature of the object concerned and the target fan rotation speed.

FIG. 17 shows the correspondence relationship between the coolant temperature $T_c$ necessary for cooling in this case, and the tank temperature $T_t$ and the target fan rotation speed $N_a$.

That is, as shown in FIG. 17, a correspondence relationship between the coolant temperature $T_c$ and the target fan rotation speed $N_a$ is set beforehand, and a correspondence relationship between the tank temperature $T_t$ and the target fan rotation speed $N_a$ is also set beforehand. It is therefore possible to determine the target fan rotation speed $N_{a1}$ corresponding to the current coolant temperature $T_{c1}$. It is also possible to determine the target fan rotation speed $N_{a2}$ corresponding to the current tank temperature $T_{t2}$. Of the target fan rotation speeds $N_{a1}$ and $N_{a2}$ thereby obtained, the larger of the two MAX($N_{a1}$, $N_{a2}$) is taken as the final target fan rotation speed. Note that cooling may also be performed in relation to objects other than the coolant and tank. In this case the target fan rotation speed $N_a$ necessary for cooling can be determined from $N_a$=MAX($N_{a1}$, $N_{a2}$, $N_{a3}$, . . . ) where $N_{a1}$, $N_{a2}$, $N_{a3}$, . . . are the target fan rotation speeds obtained for each cooled object.

In this way, when the target fan rotation speed $N_a$ corresponding to the temperature $T_t$ (e.g. pressure oil temperature $T_{t2}$) sensed by the temperature sensor 45*a* is determined in the controller 13, the target absorption torque $T_{ra}$ corresponding to this target fan rotation speed $N_a$ is determined according to formula (11) above ($T_r$=$k_1$ ·N^2). The command current i needed to set the absorption torque $T_{ra}$ obtained in this way in TC valve 25 is then output to the electromagnetic proportional control valve 24.

Here, if we assume that command current i is a command that sets the maximum absorption torque value $T_{ra1}$, then the pilot pressure $P_p$ applied to the TC valve 25 from the electromagnetic proportional control valve 24 is cut off. The action of the TC valve 25 at this time is described below.

When the drive pressure P of the hydraulic motor 7 (pump discharge pressure P) which is applied to the pilot port 25*b* of the TC valve 25 exceeds the spring force of the spring 25*a,* the TC valve 25 is pushed toward the right side of the figure and the valve position moves toward the left side of the figure. This allows the pressure oil to flow into the servo piston 26 from the TC valve 25 via the duct 35. Consequently, the servo piston 26 is moved toward the minimum capacity MIN and the swash plate 7*c* of the fan drive hydraulic motor 7 is driven to the minimum capacity side. As a result, the capacity D of the fan drive hydraulic motor 7 is decreased.

On the other hand, when the drive pressure P of the hydraulic motor 7 (pump discharge pressure P) which is applied to the pilot port 25*b* of the TC valve 25 becomes smaller than the spring force of the spring 25*a,* the TC valve 25 is pushed toward the left side of the figure and the valve position moves toward the right side of the figure. This allows the pressure oil to flow from the servo piston 26 to the tank 9 via the duct 35 and the TC valve 25. Consequently, the servo piston 26 is moved toward the maximum capacity MAX and the swash plate 7*c* of the fan drive hydraulic motor 7 is driven to the maximum capacity side. As a result, the capacity D of the fan drive hydraulic motor 7 is increased.

Also, when the drive pressure P of the hydraulic motor 7 (pump discharge pressure P) which is applied to the pilot port 25*b* of the TC valve 25 is in equilibrium with the spring force of the spring 25*a,* the TC valve 25 is moved to the central valve position. When it is situated at this central position, the pressure oil discharged from the hydraulic pump 2 passes through a choke inside the TC valve 25 via the duct 32. It also passes through the fixed choke 34 in the duct 33. As a result, the discharge pressure P of the hydraulic pump 2 is reduced to the pressure $P_{mLS}$, after which it flows into the check valve 19.

In this way, the values of the drive pressure P and capacity D of the fan drive hydraulic motor 7 are varied over the curve Al in FIG. 16, whereby the product of the drive pressure P and capacity D of fan drive hydraulic motor 7 is matched to the set absorption torque $T_{ra1}$ .

Also, if a lower rotation speed is arrived at for target fan rotation speed $N_a$, a command current i for foming a lower set absorption torque $T_{ra2}$ or an even lower absorption torque $T_{ra3}$ is output to the electromagnetic proportional control valve 24 from the controller 13. Consequently, the pilot pressure $P_p$ applied to the TC valve 25 from the electromagnetic proportional control valve 24 increases.

At this time, since the pilot pressure $P_p$ applied to pilot port 25*c* of the TC valve 25 increases, the spring force from the spring 25*a* provided opposite the pilot port 25*c* is made stronger. Accordingly, a lower set absorption torque $T_{ra2}$ or an even lower absorption torque $T_{ra3}$ is set by the TC valve 25.

Thus, when a command current i for setting the set absorption torque $T_{ra2}$ is output from the controller 13, the values of the drive pressure P and capacity D of the fan drive hydraulic motor 7 are varied along the curve $A_2$ in FIG. 16, and the product of the drive pressure P and capacity D of the fan drive hydraulic motor 7 is matched to the set absorption torque $T_{ra2}$. Also, when a command current i for setting the set absorption torque $T_{ra3}$ is output from the controller 13, the values of the drive pressure P and capacity D of fan drive hydraulic motor 7 are varied along the curve $A_3$ in FIG. 16, and the product of the drive pressure P and capacity D of the fan drive hydraulic motor 7 is matched to the set absorption torque $T_{ra3}$.

In this way, the absorption torque $T_r$ of fan drive hydraulic motor 7 is held at a constant set absorption torque value $T_{ra1}$, $T_{ra2}$ or $T_{ra3}$. As a result, fluctuations in the fan rotation speed Nofthe cooling fan 8 are suppressed and the rotation is stabilized.

Incidentally, the pressure oil discharged from the hydraulic pump 2 and the pressure oil from the tank 9 are made to flow into the inflow port 7*a* of fan drive hydraulic motor 7 by way of ducts 28, 31, 29 and 17 and a check valve 30. It is thereby possible to prevent the occurrence of cavitation in circumstances such as when the discharge flow rate of hydraulic the pump 2 has dropped suddenly.

Note that when controlling the rotation speed of the cooling fan 8 in the controller 13 as described above (absorption torque control), it is also possible to perform feedback control with the actual fan rotation speed N of the cooling fan 8 as sensed by fan rotation speed sensor 36 used as a feedback signal, so that the difference between the target fan rotation speed $N_a$ and the actual fan rotation speed N becomes zero.

Figure 13:
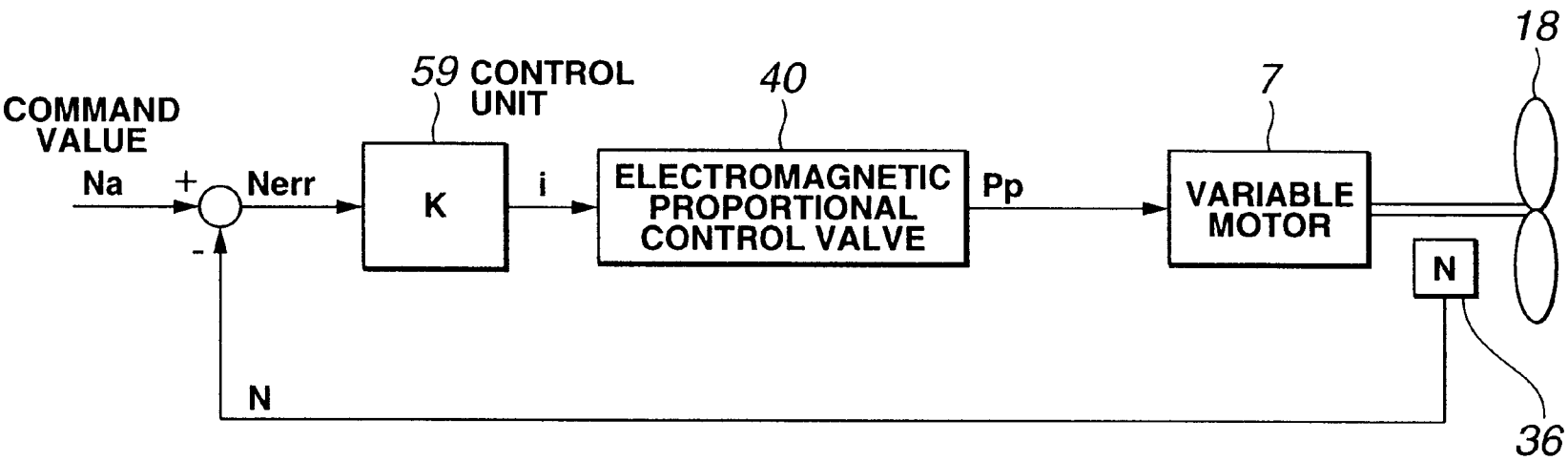
FIG. 13 shows a control block diagram of an embodiment mode.

FIG. 13 shows a control block diagram of this embodiment mode. The control unit 59 in FIG. 13 corresponds to the controller 13 in FIG. 10. The difference $N_{err}$ between the target rotation speed $N_a$ of the cooling fan 8 and the actual fan rotation speed N sensed by the fan rotation speed sensor 36 is calculated and applied to the control unit 59. Then, in the control unit 59, a command current i which is necessary for making the difference $N_{err}$ zero and for setting the absorption torque $T_{ra}$ in the TC valve 25 is generated and output to the electromagnetic proportional control valve 24.

Needless to say, the fan rotation speed could also be controlled by open-loop control without basing the control on the actual fan rotation speed N of the cooling fan 8 as sensed by the fan rotation speed sensor 36.

The actions (r), (s) and (t) corresponding to the operational modes of the working equipment are described next. In the following description, it is assumed that $T_{ra1}$ is set as the set absorption torque $T_r$.

(r) When the cooling fan and operating equipment work together and the load on the operating equipment is small.

Here we consider the case where the cooling fan 8 and the working equipment operated by the hydraulic cylinder 4 work together and the load on the operating equipment is small.

At the LS valve 20 on the side of hydraulic pump 2, load sensing control is performed to make the pressure difference P between the discharge pressure P of the hydraulic pump 2 and the signal pressure corresponding to the load pressure $P_{LS}$ of the hydraulic cylinder 4 equal to a first set pressure difference. Here, the hydraulic pump 2 is used as a common hydraulic drive source for the hydraulic cylinder 4 and the fan drive hydraulic motor 7. This gives rise to the following problem.

Assuming conditions under which the load on hydraulic cylinder 4 (the load on the operating equipment) is light, the signal pressure corresponding to the load pressure $P_{LS}$ on hydraulic cylinder 4 becomes small. Accordingly, when load sensing control is performed at the LS valve 20, the discharge pressure P of the hydraulic pump 2 decreases in line with the reduction of the signal pressure corresponding to the load pressure $P_{LS}$ of hydraulic cylinder 4. The flow rate supplied from the hydraulic pump 2 to the fan drive hydraulic motor 7 thus becomes insufficient. Consequently, it becomes impossible to secure the minimum torque necessary for rotating the fan drive hydraulic motor 7.

Therefore in the present embodiment mode, the minimum torque necessary for rotating the fan drive hydraulic motor 7 is secured in the following way.

That is, the pressure on the outlet side of the check valve 19 at this time is a signal pressure corresponding to the load pressure $P_{LS}$ of the hydraulic cylinder 4, while the pressure on the inlet side of the check valve 19 is $P_{mLS}$. This pressure $P_{mLS}$ more or less matches the discharge pressure of the hydraulic pump 2 (the load pressure of fan drive hydraulic motor 7).

Under conditions where the load on the hydraulic cylinder 4 (the load on the operating equipment is light), the pressure $P_{mLS}$ is greater than the signal pressure corresponding to the load pressure $P_{LS}$, and so the pressure oil indicating the pressure $P_{mLS}$ is made to flow out from check valve 19 to the duct 18, and is applied to pilot port 20*c* of the LS valve 20 via the duct 18 and an LS pressure duct 16. Note that instead of the check valve 19, it is possible to use any member capable of selecting the larger pressure from the signal pressure corresponding to the load pressure $P_{LS}$ and the pressure $P_{mLS}$, and of guiding it to the LS valve 20 in the same way as the check valve 19. Consequently, in the LS valve 20, load sensing control is performed whereby the pressure difference between the discharge pressure P of the hydraulic pump 2 and the abovementioned selected pressure $P_{mLS}$ is made to form the first set pressure difference. Since the selected pressure $P_{mLS}$ is greater than the signal pressure corresponding to the load pressure $P_{LS}$ of the hydraulic cylinder 4, the discharge pressure P of the hydraulic pump 2 increases accordingly. The drive pressure P of the fan drive hydraulic motor 7 thus increases. That is, as shown in FIG. 16, the drive pressure P of the fan drive hydraulic motor 7 is increased to $P_c$. When the drive pressure $P_c$ of the hydraulic motor 7 applied to the pilot port 25*b* of the TC valve 25 is in equilibrium with the spring force of the spring 25*a*, the TC valve 25 is positioned at the central valve position. When it is positioned at this central valve position, the discharge pressure of the hydraulic pump 2 passes through the interior of the TC valve 25 and a fixed choke 33. As a result, the discharge pressure $P_c$ of the hydraulic pump 2 is decreased to the pressure $P_{mLS}$, after which it is made to flow out from the check valve 19 and is applied to the pilot port 20*c* of the LS valve 20.

In this way, the absorption torque of the fan drive hydraulic motor 7 is matched at pressure $P_c$ to the set absorption torque, and the minimum torque necessary for rotating fan drive hydraulic motor 7 is secured. On the other hand, at the LS valve 20 on the side of the hydraulic pump 2, load sensing control is performed using a pressure $P_{mLS}$ that is higher than the signal pressure corresponding to the load pressure $P_{LS}$ of the hydraulic cylinder 4.

(s) When the cooling fan works independently.

Here we consider the case where only the cooling fan 8 is operating, and the operating equipment operated by the hydraulic cylinder 4 is not operating. In this case, like the case where the cooling fan and operating equipment work together, the minimum torque necessary for rotating the fan drive hydraulic motor 7 is secured by matching the fan drive hydraulic motor 7 to the pressure $P_c$. On the other hand, a state is entered in which a pressure $P_{mLS}$ that is higher than the signal pressure corresponding to the load pressure $P_{LS}$ of the hydraulic cylinder 4 is applied to pilot port 20*c* of the LS valve 20 on the side of the hydraulic pump 2.

(t) When the cooling fan and operating equipment work together and the load on the operating equipment is large.

Here we consider the case where the cooling fan 8 and the working equipment operated by the hydraulic cylinder 4 work together and the load on the operating equipment is large.

At the LS valve 20 on the side of the hydraulic pump 2, load sensing control is performed to make the pressure difference ΔP between the discharge pressure P of the hydraulic pump 2 and the signal pressure corresponding to the load pressure $P_{LS}$ of the hydraulic cylinder 4 equal to a first set pressure difference.

Assuming conditions under which the load on hydraulic cylinder 4 (the load on the operating equipment) is large, the signal pressure corresponding to the load pressure $P_{LS}$ on hydraulic cylinder 4 becomes large. Accordingly, when load sensing control is performed at the LS valve 20, the discharge pressure P of the hydraulic pump 2 increases in line with the increase of the signal pressure corresponding to the load pressure $P_{LS}$ of the hydraulic cylinder 4. Accordingly, the drive pressure P of the fan drive hydraulic motor 7 increases. That is, as shown in FIG. 16, the drive pressure P of the fan drive hydraulic motor 7 is increased to $P_a$. In line with this increase, the capacity D of the fan drive hydraulic motor 7 is reduced to $D_a$. When the drive pressure $P_a$ of the hydraulic motor 7 applied to the pilot port 25*b* of the TC valve 25 is in equilibrium with the spring force of the spring 25*a*, the TC valve 25 is positioned at the central valve position. At this time, the capacity D of fan drive hydraulic motor 7 is set to $D_a$. When the TC valve 25 is positioned at the central valve position, the pressure oil discharged from hydraulic pump 2 passes through the interior of the TC valve 25 and the fixed choke 33. The pressure at the outlet side of the check valve 19 is a signal pressure corresponding to the load pressure $P_{LS}$ of the hydraulic cylinder 4, and the pressure at the inlet side of check valve 19 is $P_{mLS}$.

Under conditions where the load on the hydraulic cylinder 4 (the load on the operating equipment) is large, the signal pressure corresponding to the load pressure $P_{LS}$ is greater than the pressure $P_{mLS}$, and so the pressure oil indicating the pressure $P_{mLS}$ does not flow out from the check valve 19 to the duct 18. Consequently, in the LS valve 20, load sensing control is performed whereby the pressure difference ΔP between the discharge pressure P of the hydraulic pump 2 and the signal pressure corresponding to the load pressure $P_{LS}$ of the hydraulic cylinder 4 is made to form the first set pressure difference.

In this way, the fan drive hydraulic motor 7 is matched at pressure $P_a$ to the set absorption torque, and the fan drive hydraulic motor 7 is driven with a constant absorption torque $T_{ra1}$. On the other hand, at the LS valve 20 on the side of hydraulic pump 2, load sensing control is performed using a signal pressure corresponding to the load pressure $P_{LS}$ of the hydraulic cylinder 4.

In the above way, with the embodiment mode shown in FIG. 10, torque control valve 25 is driven and controlled according to a command i for making the absorption torque $T_r$ of the fan drive hydraulic motor 7 equal to a set absorption torque value $T_{ra}$. As a result, the absorption torque $T_r$ is held at a constant set torque value $T_{ra}$ even under conditions where the absorption torque $T_r$ of the fan drive hydraulic motor 7 fluctuates. Consequently, fluctuations in the fan rotation speed N of the cooling fan 8 are suppressed and the rotation is stabilized.

Furthermore, in the present embodiment, since load sensing control and control of the cooling fan rotation speed or temperature control are performed simultaneously, it is possible to increase the overall energy efficiency of both the hydraulic actuator 4 and the fan drive hydraulic motor 7.

What is claimed is:

1. A cooling fan drive control device comprising a hydraulic pump driven by a drive source, a cooling fan which cools cooling water of the drive source and also cools pressure oil of equipment operated by the drive source, and a hydraulic motor which is operated by pressure oil discharged from the hydraulic pump and causes the cooling fan to rotate, wherein the cooling fan drive control device further comprises:

a cooling water temperature sensing means which senses a temperature of the cooling water;

a pressure oil temperature sensing means which senses a temperature of the pressure oil;

a target fan rotation speed setting means which sets a target fan rotation speed to a first target fan rotation speed corresponding to the cooling water temperature sensed by the cooling water temperature sensing means, or to a second target fan rotation speed corresponding to the pressure oil temperature sensed by the pressure oil temperature sensing means, whichever is the larger; and a capacity control means which controls a capacity of the hydraulic pump or the hydraulic motor according to a difference between a fan rotation speed of the cooling fan and the target fan rotation speed set by the target fan rotation speed setting means.

2. The cooling fan drive control device according to claim 1, which comprises:

a fan rotation speed sensing means which senses the rotation speed of the cooling fan, wherein the capacity control means controls the capacity of the hydraulic pump or the hydraulic motor according to the difference between the target fan rotation speed set by the target fan rotation speed setting means and the fan rotation speed sensed by the fan rotation speed sensing means.

3. A cooling fan drive control device comprising a hydraulic pump driven by a drive source, a cooling fan which cools cooling water of the drive source, and a hydraulic motor which is operated by pressure oil discharged from the hydraulic pump and causes the cooling fan to rotate, wherein the cooling fan drive control device further comprises:

a capacity control means which controls a capacity of the hydraulic pump or the hydraulic motor according to a difference between a temperature of the cooling water and a target temperature.

4. A cooling fan drive control device comprising a hydraulic pump driven by a drive source, a cooling fan which cools pressure oil of equipment operated by the drive source, and a hydraulic motor which is operated by pressure oil discharged from the hydraulic pump and causes the cooling fan to rotate, wherein the cooling fan drive control device further comprises:

a capacity control means which controls a capacity of the hydraulic pump or the hydraulic motor according to a difference between a temperature of the pressure oil and a target temperature.

5. The cooling fan drive control device according to claim 1, wherein the capacity control means performs control to gradually change the fan rotation speed of the cooling fan until the fan rotation speed of the cooling fan reaches the target fan rotation speed set by the target fan rotation speed setting means.

6. The cooling fan drive control device as claimed in claim 1, which comprises:

a compensation means which, when the target fan rotation speed set by the target fan rotation speed setting means is greater than or equal to a prescribed limiting rotation speed, compensates the target fan rotation speed to the limiting rotation speed, wherein the capacity control means controls the capacity of the hydraulic pump or the hydraulic motor according to the difference between the fan rotation speed of the cooling fan and the compensated target fan rotation speed compensated by the compensation means.

7. The cooling fan drive control device according to claim 1, which performs control to rotate the cooling fan in an opposite rotation direction to a direction of rotation when cooling the cooling water or the pressure oil at a prescribed time or at prescribed time intervals.

8. The cooling fan drive control device according to claim 1, wherein the capacity control means performs control to minimize the capacity of the hydraulic pump or the hydraulic motor when the drive source is started up.

9. The cooling fan drive control device as claimed in claim 1, which performs control to increase the rotation speed of the cooling fan to approximately a maximum rotation speed at prescribed time intervals.

10. The cooling fan drive control device as claimed in claim 1, comprising:

an indication means that indicates the target fan rotation speed, wherein the target fan rotation speed setting means sets a target fan rotation speed corresponding to target fan rotation speed indication details indicated by the indication means.

11. The cooling fan drive control device as claimed in claim 1, comprising a hydraulic actuator which is operated by pressure oil discharged from the hydraulic pump being supplied via an operating valve, and a pump capacity control valve which changes the capacity of the hydraulic pump so that a difference in pressure between a discharge pressure of the hydraulic pump and a load pressure of the hydraulic actuator becomes a desired set pressure difference.

12. The cooling fan drive control device according to claim 1, which comprises;

a fan rotation speed sensing means which senses the rotation speed of the cooling fan, wherein the capacity control means controls the capacity of the hydraulic pump or the hydraulic motor according to the differences between the target fan rotation speed set by the target fan rotation speed setting means and the fan rotation speed sensed by the fan rotation speed sensing means.

13. The cooling fan drive control device according to claim 1, wherein the capacity control means performs control to gradually change the fan rotation speed of the cooling fan until the fan rotation speed of the cooling fan reaches the target fan rotation speed set by the target fan rotation speed means.

14. The cooling fan drive control device as claimed in claim 1, which comprises:

a compensation means which, when the target fan rotation speed set by the target fan rotation speed setting means is greater than or equal to a prescribed limiting rotation speed, compensates the target fan rotation speed to the limiting rotation speed, wherein the capacity control means controls the capacity of the hydraulic pump or the hydraulic motor according to the difference between the fan rotation speed of the cooling fan and the compensated target fan rotation speed compensated by the compensation means.

15. A cooling fan drive control device comprising a hydraulic pump driven by a drive source, a cooling fan that cools pressure oil of equipment operated by the drive source, and a hydraulic motor which is operated by pressure oil discharged from the hydraulic pump and causes the cooling fan to rotate, wherein the cooling fan drive control device further comprises:

a pressure oil temperature sensing means which senses a temperature of the pressure oil;

a target fan rotation speed setting means which sets a target fan rotation speed corresponding to the temperature sensed by the pressure oil temperature sensing means; and a capacity control means which controls a capacity of the hydraulic pump or the hydraulic motor according to a difference between a fan rotation speed of the cooling fan and the target fan rotation speed set by the target fan rotation speed setting, and wherein the cooling fan drive control device performs control to rotate the cooling fan in an opposite rotation direction to direction of rotation when cooling the cooling water or the pressure oil at a prescribed time or at prescribed time intervals.

16. A cooling fan drive control device comprising a hydraulic pump driven by a drive source, a cooling fan which cools cooling water of the drive source and also cools pressure oil of equipment operated by the drive source, and a hydraulic motor which is operated by pressure oil discharged from the hydraulic pump and causes the cooling fan to rotate, wherein the cooling fan drive control device further comprises:

a cooling water temperature sensing means which senses a temperature of the cooling water;

a pressure oil temperature sensing means which senses a temperature of the pressure oil;

a target fan rotation speed setting means which sets a target fan rotation speed to a first target fan rotation speed corresponding to the cooling water temperature sensed by the cooling water temperature sensing means, or to a second target fan rotation speed corresponding to the pressure oil temperature sensed by the pressure oil temperature sensing means, whichever is the larger; and a capacity control means which controls a capacity of the hydraulic pump or the hydraulic motor according to a difference between a fan rotation speed of the cooling fan and the target fan rotation speed set by the target fan rotation speed setting means, and wherein the cooling fan drive control device performs control to rotate the cooling fan in an opposite rotation direction to direction of rotation when cooling the cooling water or the pressure oil at a prescribed time or at prescribed time intervals.

17. A cooling fan drive control device comprising a hydraulic pump driven by a drive source, a cooling fan which cools cooling water of the drive source, and a hydraulic motor which is operated by pressure oil discharged from the hydraulic pump and causes the cooling fan to rotate, wherein the cooling fan drive control device further comprises:

a capacity control means which controls a capacity of the hydraulic pump or the hydraulic motor according to a difference between a temperature of the cooling water and a target temperature, and wherein the cooling fan drive control device performs control to rotate the cooling the cooling water at a prescribed time or at prescribed time intervals.

18. A cooling fan drive control device comprising a hydraulic pump driven by a drive source, a cooling fan which cools pressure oil of equipment operated by the drive source, and a hydraulic motor which is operated by pressure oil discharged from the hydraulic pump and causes the cooling fan to rotate, wherein the cooling fan drive control device further comprises:

a capacity control means which controls a capacity of the hydraulic pump or the hydraulic motor according to a difference between a temperature of the pressure oil and a target temperature, and wherein the cooling fan drive control device performs control to rotate the cooling fan in an opposite rotation direction to a direction of rotation when cooling the pressure oil at a prescribed time or at prescribed time intervals.

19. The cooling fan drive control device according to claim 1, wherein the capacity control means performs control to minimize the capacity of the hydraulic pump or the hydraulic motor when the drive source is started up.

20. The cooling fan drive control device according to claim 3, wherein the capacity control means performs control to minimize the capacity of the hydraulic pump or the hydraulic motor when the drive source is started up.

21. The cooling fan drive control device according to claim 4, wherein the capacity control means performs control to minimize the capacity of the hydraulic pump or the hydraulic motor when the drive source is started up.

22. The cooling fan drive control device according to claim 1, which performs control to increase the rotation speed of the cooling fan to approximately a maximum rotation speed at prescribed time intervals.

23. The cooling fan drive control device according to claim 3, which performs control to increase the rotation speed of the cooling fan to approximately a maximum rotation speed at prescribed time intervals.

24. The cooling fan drive control device according to claim 4, which performs control to increase the rotation speed of the cooling fan to approximately a maximum rotation speed at prescribed time intervals.

25. The cooling fan drive control device according to claim 1, comprising an indication means that indicates the target fan rotation speed, wherein the target fan rotation speed setting means sets a target fan rotation speed corresponding to target fan rotation speed indication details indicated by the indication means.

26. The cooling fan drive control device according to claim 3, comprising an indication means that indicates the target fan rotation speed, wherein the target fan rotation speed setting means sets a target fan rotation speed corresponding to target fan rotation speed indication details indicated by the indication means.

27. The cooling fan drive control device according to claim 4, comprising an indication means that indicates the target fan rotation speed, wherein the target fan rotation speed setting means sets a target fan rotation speed corresponding to target fan rotation speed indication details indicated by the indication means.

28. The cooling fan drive control device as claimed in claim 1, comprising a hydraulic actuator which is operated by pressure oil discharged from the hydraulic pump being supplied via an operating valve, and a pump capacity control valve which changes the capacity of the hydraulic pump so that a difference in pressure between a discharge pressure of the hydraulic pump and a load pressure of the hydraulic actuator becomes a desired set pressure difference.

29. The cooling fan drive control device as claimed in claim 3, comprising a hydraulic actuator which is operated by pressure oil discharged from the hydraulic pump being supplied via an operating valve, and a pump capacity control valve which changes the capacity of the hydraulic pump so that a difference in pressure between a discharge pressure of the hydraulic pump and a load pressure of the hydraulic actuator becomes a desired set pressure difference.

30. The cooling fan drive control device as claimed in claim 4, comprising a hydraulic actuator which is operated by pressure oil discharged from the hydraulic pump being supplied via an operating valve, and a pump capacity control valve which changes the capacity of the hydraulic pump so that a difference in pressure between a discharge pressure of the hydraulic pump and a load pressure of the hydraulic actuator becomes a desired set pressure difference.

31. A cooling fan drive control device comprising a hydraulic pump driven by a drive source, a cooling fan which cools cooling water of the drive source, and a hydraulic motor which is operated by pressure oil discharged from the hydraulic pump and causes the cooling fan to rotate, wherein the cooling fan drive control device further comprises:

a capacity control means which controls a capacity of the hydraulic pump or the hydraulic motor according to a difference between a temperature of the cooling water and a target temperature at which an output efficiency of the drive source becomes maximum.

32. A cooling fan drive control device comprising a hydraulic pump driven by a drive source, a cooling fan which cools pressure oil of equipment operated by the drive source, and a hydraulic motor which is operated by pressure oil discharged from the hydraulic pump and causes the cooling fan to rotate, wherein the cooling fan drive control device further comprises:

a capacity control means which controls a capacity of the hydraulic pump or the hydraulic motor according to a difference between a temperature of the pressure oil and a target temperature at which an output efficiency of the drive source becomes maximum.

* * * * *